US008086152B2

(12) United States Patent
Yamada et al.

(10) Patent No.: US 8,086,152 B2
(45) Date of Patent: Dec. 27, 2011

(54) DEVELOPING DEVICE, IMAGE FORMING APPARATUS, IMAGE FORMING SYSTEM, DEVELOPING METHOD, AND TONER BEARING MEMBER

(75) Inventors: Yoichi Yamada, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 502 days.

(21) Appl. No.: 12/124,939

(22) Filed: May 21, 2008

(65) Prior Publication Data

US 2008/0298853 A1 Dec. 4, 2008

(30) Foreign Application Priority Data

May 30, 2007 (JP) ..... 2007-144061
May 30, 2007 (JP) ..... 2007-144062
May 30, 2007 (JP) ..... 2007-144065

(51) Int. Cl.
*G03G 15/08* (2006.01)

(52) U.S. Cl. ..... 399/279

(58) Field of Classification Search ..... 399/279, 399/274, 264, 284, 286
See application file for complete search history.

(56) References Cited

U.S. PATENT DOCUMENTS 4,092,165 A 5/1978 Andrus et al.
4,368,971 A 1/1983 Watanabe et al.
4,780,741 A 10/1988 Wada et al.
4,978,583 A 12/1990 Wakui et al.
5,153,376 A 10/1992 Tomita
5,339,141 A 8/1994 Suzuki et al.
5,387,966 A 2/1995 Karashima
5,391,135 A 2/1995 Kuroki et al.
5,502,552 A 3/1996 Iwata et al.
5,552,235 A 9/1996 Bastawros et al.
5,794,109 A 8/1998 Ota et al.
5,797,827 A 8/1998 Sondergeld
5,812,917 A 9/1998 Iwata et al.
6,183,927 B1 2/2001 Magome et al.
6,201,942 B1 3/2001 Honda et al.
6,317,220 B1 11/2001 Fujita et al.
6,360,069 B1 3/2002 Mimura et al.
6,512,598 B2 1/2003 Fujita et al.
(Continued)

FOREIGN PATENT DOCUMENTS

CN 1959553 A 5/2007
(Continued)

OTHER PUBLICATIONS

Extended European search report dated Feb. 4, 2011 for corresponding European application 08009803.1 lists the references above.

*Primary Examiner* — David Gray
*Assistant Examiner* — Rodney Bonnette
(74) *Attorney, Agent, or Firm* — DLA Piper LLP (US)

(57) ABSTRACT

The present invention provides a developing device that includes a toner bearing member that includes regularly arranged projection sections and depressed sections for bearing toner, and that develops a latent image borne on an image bearing member with the toner borne on the projection sections and the depressed sections, wherein the latent image is developed in a state in which a projection section covering ratio at which toner contacting the projection sections covers the projection sections is smaller than a depressed section covering ratio at which toner contacting the depressed sections covers the depressed sections.

18 Claims, 15 Drawing Sheets

U.S. PATENT DOCUMENTS

| | | | | |
|---|---|---|---|---|
| 6,873,816 | B2 | 3/2005 | Akashi et al. | |
| 6,925,277 | B2 | 8/2005 | Sugihara | |
| 6,941,100 | B2 | 9/2005 | Yamada et al. | |
| 2005/0176566 | A1 | 8/2005 | Vestola et al. | |
| 2006/0056880 | A1 | 3/2006 | Okamoto | |
| 2006/0099011 | A1 | 5/2006 | Kamijo et al. | |
| 2006/0111223 | A1 | 5/2006 | Chou | |
| 2007/0110481 | A1 | 5/2007 | Yamada et al. | |
| 2007/0110484 | A1* | 5/2007 | Yamada et al. | 399/286 |
| 2008/0298851 | A1* | 12/2008 | Yamada et al. | 399/279 |
| 2008/0298852 | A1* | 12/2008 | Yamada | 399/279 |

FOREIGN PATENT DOCUMENTS

| | | | |
|---|---|---|---|
| EP | 1372045 | A2 | 12/2003 |
| JP | 55026526 | A | 2/1980 |
| JP | 59189374 | A | 10/1984 |
| JP | 61147264 | A | 7/1986 |
| JP | 63304277 | A | 12/1988 |
| JP | 01102486 | A | 4/1989 |
| JP | 02235080 | A | 9/1990 |
| JP | 04295871 | A | 10/1992 |
| JP | 05025459 | A | 4/1993 |
| JP | 05142950 | A | 6/1993 |
| JP | 06-124043 | | 5/1994 |
| JP | 06138774 | A | 5/1994 |
| JP | 07013410 | A | 1/1995 |
| JP | 08160736 | A | 6/1996 |
| JP | 08286497 | A | 11/1996 |
| JP | 08328376 | A | 12/1996 |
| JP | 09197800 | A | 7/1997 |
| JP | 10207172 | A | 8/1998 |
| JP | 11133728 | A | 5/1999 |
| JP | 11174821 | A | 7/1999 |
| JP | 2000-258989 | | 9/2000 |
| JP | 2000242073 | A | 9/2000 |
| JP | 2000275957 | A | 10/2000 |
| JP | 2001134069 | A | 5/2001 |
| JP | 2002-112224 | | 4/2002 |
| JP | 2002372855 | A | 12/2002 |
| JP | 2003-057940 | | 2/2003 |
| JP | 2003057940 | A | 2/2003 |
| JP | 2003107905 | A | 4/2003 |
| JP | 2003208012 | A | 7/2003 |
| JP | 2003263018 | A | 9/2003 |
| JP | 2003316146 | A | 11/2003 |
| JP | 2004020581 | A | 1/2004 |
| JP | 2004034537 | A | 2/2004 |
| JP | 2004212520 | A | 7/2004 |
| JP | 2005049649 | A | 2/2005 |
| JP | 2006-259384 | | 9/2006 |
| JP | 2006343542 | A | 12/2006 |
| JP | 2007-121947 | | 5/2007 |
| JP | 2007-121950 | | 5/2007 |
| JP | 2007121974 | A | 5/2007 |
| JP | 2007127800 | A | 5/2007 |
| JP | 4715451 | B2 | 7/2011 |

* cited by examiner

DEVELOPING DEVICE, IMAGE FORMING APPARATUS, IMAGE FORMING SYSTEM, DEVELOPING METHOD, AND TONER BEARING MEMBER

CROSS-REFERENCE TO RELATED APPLICATIONS

The present application claims priority upon Japanese Patent Application No. 2007-144061 filed on May 30, 2007, Japanese Patent Application No. 2007-144062 filed on May 30, 2007, and Japanese Patent Application No. 2007-144065 filed on May 30, 2007, which are herein incorporated by reference.

BACKGROUND

1. Technical Field

The present invention relates to developing devices, image forming apparatuses, image forming systems, developing methods, and toner bearing members.

2. Related Art

Image forming apparatuses such as laser beam printers are already well known. Such an image forming apparatus includes, for example, a photoconductor, which is an example of an image bearing member that bears latent images, and a developing device provided with a toner bearing roller, which is an example of a toner bearing member that bears toner and develops latent images borne on the photoconductor using the toner. And upon an image signal or the like arriving from an external device such as a computer, the image forming apparatus positions the developing device at a developing position where the toner bearing roller opposes the photoconductor, and forms a toner image on the photoconductor by developing the latent image borne on the photoconductor with the toner bearing roller. Then, the image forming apparatus transfers the toner image to a medium and finally the image is formed on the medium.

In this regard, sometimes a toner having a slow electrical-charge buildup (toner that takes time for its charging amount to reach a saturated charge amount) is used as the toner in this image forming apparatus. And a phenomenon called development memory can occur due to the slowness of the electrical-charge buildup in the case where the latent image is to be developed using this toner. And occurrences of this phenomenon are a cause of deterioration of image quality in images formed by the image forming apparatus.

It should be noted that JP-A-2006-259384 and JP-A-2003-57940 are examples of related technology.

SUMMARY

The invention was achieved to address the above-described problems, and the advantage thereof is to appropriately prevent deterioration of image quality in images.

A primary aspect of the present invention is a developing device including:

a toner bearing member that includes regularly arranged projection sections and depressed sections for bearing toner, and that develops a latent image borne on an image bearing member with the toner borne on the projection sections and the depressed sections, wherein the latent image is developed in a state in which a projection section covering ratio at which toner contacting the projection sections covers the projection sections is smaller than a depressed section covering ratio at which toner contacting the depressed sections covers the depressed sections.

Features and advantages of the invention other than the above will become clear by reading the description of the present specification with reference to the accompanying drawings.

BRIEF DESCRIPTION OF THE DRAWINGS

For a more complete understanding of the invention and the advantages thereof, reference is now made to the following description taken in conjunction with the accompanying drawings wherein.

DESCRIPTION OF EXEMPLARY EMBODIMENTS

Figure 1:
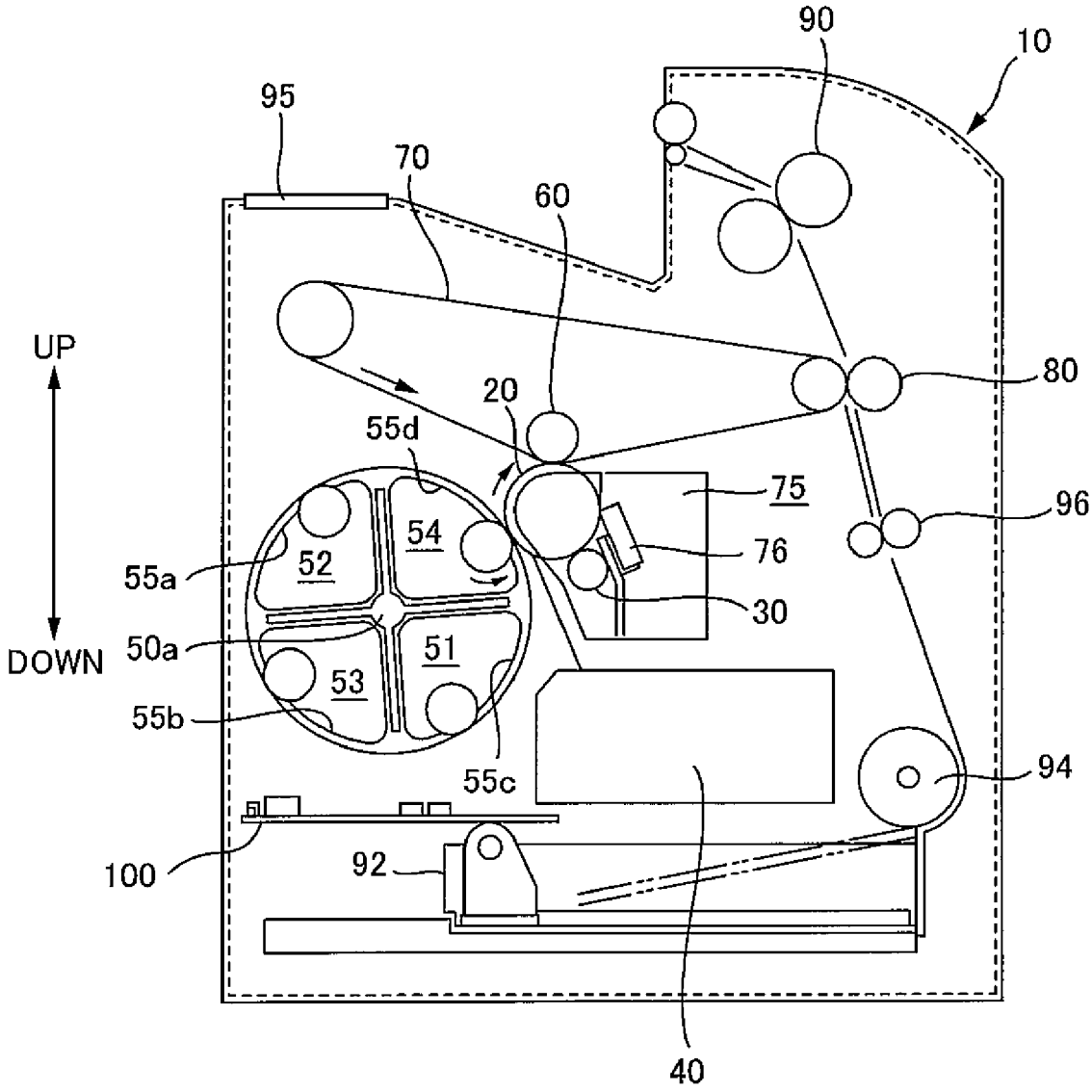
FIG. 1 is a diagram showing main structural components constituting a printer 10.

At least the following matters will be made clear by reading the description of the present specification with reference to the accompanying drawings.

A developing device including a toner bearing member that includes regularly arranged projection sections and depressed sections forbearing toner, and that develops a latent image borne on an image bearing member with the toner borne on the projection sections and the depressed sections, wherein the latent image is developed in a state in which a projection section covering ratio at which toner contacting the projection sections covers the projection sections is smaller than a depressed section covering ratio at which toner contacting the depressed sections covers the depressed sections.

With such a developing device, deterioration in image quality in images is appropriately prevented.

It is possible that a developing device includes a regulation member for regulating an amount of toner borne on the projection sections and the depressed sections, wherein after the regulation member has regulated the amount of toner so that the projection section covering ratio is smaller than the depressed section covering ratio, the toner bearing member develops the latent image in a state in which the projection section covering ratio is smaller than the depressed section covering ratio.

With such a configuration, occurrences of development memory are inhibited due to action by the regulation member, and deterioration in image quality in images is appropriately prevented.

It is possible that the toner bearing member is a rotatable toner bearing roller that includes the projection sections and the depressed sections for bearing toner whose volume mean particle size is smaller than a depth of the depressed sections in reference to the projection sections, the regulation member is a regulation blade for regulating the amount of toner borne on the projection sections and the depressed sections by coming into contact with the toner bearing roller at a contact section so that a longitudinal direction of the regulation member runs along a rotation-axis direction of the toner bearing roller, and is disposed so that a leading edge of the regulation blade in a lateral direction and a thickness direction faces an upstream side of the toner bearing member in a rotating direction, and a distance from the leading edge to the projection sections in the case where the leading edge faces the projection sections among the projection sections and the depressed sections is smaller than the volume mean particle size.

With such a configuration, it is possible to realize with a simple method a state in which the projection section covering ratio is smaller than the depressed section covering ratio.

An image forming apparatus, including an image bearing member for bearing a latent image; and a developing device provided with a toner bearing member including regularly arranged projection sections and depressed sections for bearing toner, the toner bearing member developing a latent image borne on the image bearing member with the toner borne on the projection sections and the depressed sections, the toner bearing member developing the latent image in a state in which a projection section covering ratio at which toner contacting the projection sections covers the projection sections is smaller than a depressed section covering ratio at which toner contacting the depressed sections covers the depressed sections.

With such an image forming apparatus, deterioration in image quality in images is appropriately prevented.

An image forming system, including a computer, and an image forming apparatus that can be connected to the computer, the image forming apparatus including an image bearing member for bearing a latent image, and a developing device provided with a toner bearing member including regularly arranged projection sections and depressed sections for bearing toner, and that develops a latent image borne on the image bearing member with the toner borne on the projection sections and the depressed sections, the toner bearing member developing the latent image in a state in which a projection section covering ratio at which toner contacting the projection sections covers the projection sections is smaller than a depressed section covering ratio at which toner contacting the depressed sections covers the depressed sections.

With such an image forming system, deterioration in image quality in images is appropriately prevented.

A developing method, including regulating an amount of toner borne on regularly arranged projection sections and depressed sections, which are provided in a toner bearing member, so that a projection section covering ratio at which toner contacting the projection sections covers the projection sections is smaller than a depressed section covering ratio at which toner contacting the depressed sections covers the depressed sections, and developing a latent image borne on an image bearing member using toner borne on the projection sections and the depressed sections in a state in which the projection section covering ratio is smaller than the depressed section covering ratio.

With such a developing method, deterioration in image quality in images is appropriately prevented.

A developing device, including a rotatable toner bearing roller that includes regularly arranged projection sections and depressed sections and that bears toner whose volume mean particle size is smaller than a depth of the depressed sections in reference to the projection sections, the toner bearing roller developing a latent image borne on an image bearing member with the toner borne on the toner bearing roller, and a regulation blade for regulating an amount of toner borne on the toner bearing roller by contacting the toner bearing roller at a contact section so that a longitudinal direction of the regulation blade runs along a rotation-axis direction of the toner bearing roller, the regulation blade being disposed so that a leading edge of the regulation blade in a lateral direction and a thickness direction faces an upstream side of the toner bearing roller in a rotating direction, wherein a distance from the leading edge to the projection sections in the case where the leading edge faces the projection sections among the projection sections and the depressed sections is smaller than the volume mean particle size.

With such a developing device, deterioration in image quality in images is appropriately prevented.

It is possible that the contact section is positioned at a position separated from the leading edge.

With such a configuration, a problem that the leading edge is chipped will not occur.

It is possible that the distance is smaller than a value obtained by subtracting 3 times a standard deviation in a toner particle size distribution from the volume mean particle size.

With such a configuration, occurrences of development memory are further inhibited.

It is possible that a value obtained by adding 3 times a standard deviation in a toner particle size distribution to the volume mean particle size is smaller than the depth of the depressed sections.

With such a configuration, occurrences of development memory are further inhibited.

It is possible that the projection sections and the depressed sections are formed in the toner bearing roller so that the depth of the depressed sections is uniform between all the depressed sections provided in the toner bearing roller.

With such a configuration, occurrences of development memory are further inhibited.

It is possible that the projection sections have flat top surfaces.

With such a configuration, wear in the projection sections is appropriately prevented.

An image forming apparatus, including an image bearing member for bearing a latent image, a developing device provided with a rotatable toner bearing roller that includes regularly arranged projection sections and depressed sections, and that bears toner whose volume mean particle size is smaller than a depth of the depressed sections in reference to the projection sections, the toner bearing roller developing a latent image borne on the image bearing member with the toner borne on the toner bearing roller, and a regulation blade for regulating an amount of toner borne on the toner bearing roller by contacting the toner bearing roller at a contact section so that a longitudinal direction of the regulation blade runs along a rotation-axis direction of the toner bearing roller, the regulation blade being disposed so that a leading edge of the regulation blade in a lateral direction, of a contact face including the contact section, races an upstream side of the toner bearing roller in a rotating direction, wherein a distance from the leading edge to the projection sections in the case where the leading edge faces the projection sections among the projection sections and the depressed sections is smaller than the volume mean particle size.

With such an image forming apparatus, deterioration in image quality in images is appropriately prevented.

An image forming system, including a computer, and an image forming apparatus that can be connected to the computer, the image forming apparatus including an image bearing member for bearing a latent image, and a developing device provided with a rotatable toner bearing roller that includes regularly arranged projection sections and depressed sections, and that bears toner whose volume mean particle size is smaller than a depth of the depressed sections in reference to the projection sections, the toner bearing roller developing a latent image borne on the image bearing member with the toner borne on the toner bearing roller, and a regulation blade for regulating an amount of toner borne on the toner bearing roller by contacting the toner bearing roller at a contact section so that a longitudinal direction of the regulation blade runs along a rotation-axis direction of the toner bearing roller, the regulation blade being disposed so that a leading edge in a lateral direction of the regulation blade, of a contact face including the contact section faces an upstream side of the toner bearing roller in a rotating direction, wherein a distance from the leading edge to the projection sections in the case where the leading edge faces the projection sections among the projection sections and the depressed sections is smaller than the volume mean particle size.

With such an image forming system, deterioration in image quality in images is appropriately prevented.

A developing device, including a toner bearing member that bears toner on a surface thereof and that develops a latent image borne on an image bearing member with the toner, wherein the toner bearing member includes projection sections that are regularly arranged on the surface, a ten-point average roughness of the projection sections being smaller than a value obtained by subtracting 3 times a standard deviation in a particle size distribution of the toner from a volume mean particle size of the toner.

With such a developing device, deterioration in image quality in images is appropriately prevented.

It is possible that the toner bearing member is rotatable, and a regulation member is provided that regulates an amount of toner borne on the surface of the toner bearing member by contacting the surface, the regulation member being disposed so that a longitudinal direction of the regulation member runs along a rotation-axis direction of the toner bearing member, and the leading edge in a lateral direction and a thickness direction of the regulation member faces an upstream side of the toner bearing member in a rotating direction, and a distance between the leading edge and the projection sections in the case where the leading edge faces the projection sections is smaller than a value obtained by subtracting 3 times a standard deviation in a particle size distribution of the toner from a volume mean particle size of the toner.

With such a configuration, occurrences of development memory are more effectively inhibited.

It is possible that the projection sections and depressed sections that bear the toner are regularly arranged on the surface of the toner bearing member, and a ten-point average roughness of the depressed sections is larger than the ten-point average roughness of the projection sections.

With such a configuration, discharge between the depressed sections and the image bearing member that have just passed the developing position can be suppressed.

It is possible that the depressed sections are bottom portions of two types of spiral groove portions having different inclination angles with respect to a circumferential direction of the toner bearing member, the two types of spiral groove portions mutually intersect so as to form a grid pattern, the projection sections are a square top surface surrounded by the two types of spiral groove portions, and one of two diagonal lines of the square top surface runs along the circumferential direction.

A toner bearing member including a surface that bears toner for developing a latent image borne on an image bearing member, and projection sections regularly arranged on the surface, a ten-point average roughness of the projection sections being smaller than a value obtained by subtracting 3 times a standard deviation in a particle size distribution of the toner from a volume mean particle size of the toner.

With such a toner bearing member, deterioration in image quality in images is appropriately prevented.

An image forming apparatus including an image bearing member for bearing a latent image, and a developing device provided with a toner bearing member that bears toner on a surface thereof and that develops a latent image borne on the image bearing member with the toner, the toner bearing member including projection sections regularly arranged on the surface, and a ten-point average roughness of the projection sections being smaller than a value obtained by subtracting 3 times a standard deviation in a particle size distribution of the toner from a volume mean particle size of the toner.

With such an image forming apparatus, deterioration in image quality in images is appropriately prevented.

An image forming system including a computer, and an image forming apparatus that can be connected to the computer, the image forming apparatus including an image bearing member that bears a latent image, and a developing device provided with a toner bearing member that bears toner on a surface thereof and that develops a latent image borne on the image bearing member with the toner, the toner bearing member including projection sections regularly arranged on the surface thereof, and a ten-point average roughness of the projection sections being smaller than a value obtained by subtracting 3 times a standard deviation in a particle size distribution of the toner from a volume mean particle size of the toner.

With such an image forming system, deterioration in image quality in images is appropriately prevented.

Although the preferred embodiment of the invention has been described in detail, it should be understood that various changes, substitutions and alterations can be made therein without departing from spirit and scope of the inventions as defined by the appended claims.

Example of Overall Configuration of Image Forming Apparatus

Next, using FIG. 1, an outline of a laser beam printer (hereinafter, also referred to as "printer") 10 serving as an example of an image forming apparatus is described. FIG. 1 is a diagram showing the main structural components constituting the printer 10. It should be noted that in FIG. 1, the vertical direction is indicated by the arrows, and, for example, a paper supply tray 92 is arranged at a lower section of the printer 10 and a fixing unit 90 is arranged at an upper section of the printer 10.

As shown in FIG. 1, the printer 10 according to the present embodiment includes a charging unit 30, an exposing unit 40, a YMCK development unit 50, a first transferring unit 60, an intermediate transfer body 70, and a cleaning unit 74, these units being arranged along the direction of rotation of a photoconductor 20, which serves as an example of an image-bearing member. The printer 10 further includes a second transferring unit 80, a fixing unit 90, a display unit 95 constituted by a liquid-crystal panel and serving as a measure for displaying notifications to the user, and a control unit 100 for controlling these units and managing the operations of the printer.

The photoconductor 20 has a cylindrical conductive base and a photoconductive layer formed on the outer peripheral surface of the conductive base, and can rotate about its central axis. In the present embodiment, the photoconductor 20 rotates clockwise, as shown by the arrow in FIG. 1.

The charging unit 30 is a device for charging the photoconductor 20, and the exposing unit 40 is a device that irradiates a laser beam to form a latent image on the charged photoconductor 20. The exposing unit 40 includes, for example, a semiconductor laser, a polygon mirror, and an F-θ lens, and irradiates a modulated laser beam onto the charged photoconductor 20 in accordance with image signals that have been inputted from a host computer, not shown in the drawings, such as a personal computer or a word processor.

The YMCK developing unit 50 is a device that uses a toner contained in the developing device to develop the latent image formed on the photoconductor 20, that is, the toner being a black toner (K) contained in a black developing device 51, a magenta toner (M) contained in a magenta developing device 52, a cyan toner (C) contained in a cyan developing device 53, and a yellow toner (Y) contained in a yellow developing device 54.

By rotating the YMCK developing unit 50 in a state in which the four developing devices 51, 52, 53, and 54 are mounted, it is possible to move the positions of these four developing devices 51, 52, 53, and 54. More specifically, the YMCK developing unit 50 holds the four developing devices 51, 52, 53, and 54 with four holding sections 55*a*, 55*b*, 55*c*, and 55*d*, and the four developing devices 51, 52, 53, and 54 can be rotated around a central shaft 50*a* while maintaining their relative positions. Every time the image formation for one page is finished, a different one of the developing devices is caused to selectively oppose the photoconductor 20, thereby successively developing latent images formed on the photoconductor 20 with the toners contained in the developing devices 51, 52, 53, and 54. It should be noted that each of the above four developing devices 51, 52, 53, and 54 can be attached or detached from the holding sections of the YMCK developing unit 50. The developing devices are described in detail further below.

The first transferring unit 60 is a device for transferring a single color toner image formed on the photoconductor 20 to the intermediate transfer body 70, and when the four toner colors are successively transferred over one another, a full color toner image is formed on the intermediate image transfer body 70.

The intermediate image transfer body 70 is an endless belt made by providing a tin vapor deposition layer on the surface of a PET film and further forming in a layered manner a semiconductive coating on its surface, and the intermediate image transfer body 70 is driven to rotate at substantially the same peripheral speed as the photoconductor 20.

The second transferring unit 80 is a device for transferring the single-color toner image or the full-color toner image formed on the intermediate transfer body 70 onto a medium such as paper, film, or cloth.

The fixing unit 90 is a device for fusing the single-color toner image or the full-color toner image, which has been transferred to the medium, onto the medium to turn it into a permanent image.

The cleaning unit 75 is provided between the first transferring unit 60 and the charging unit 30, and has a rubber cleaning blade 76 that contacts the surface of the photoconductor 20. It is a device for removing the toner remaining on the photoconductor 20 by scraping it off with the cleaning blade 76 after the toner image has been transferred onto the intermediate transferring member 70 by the first transferring unit 60.

Figure 2:
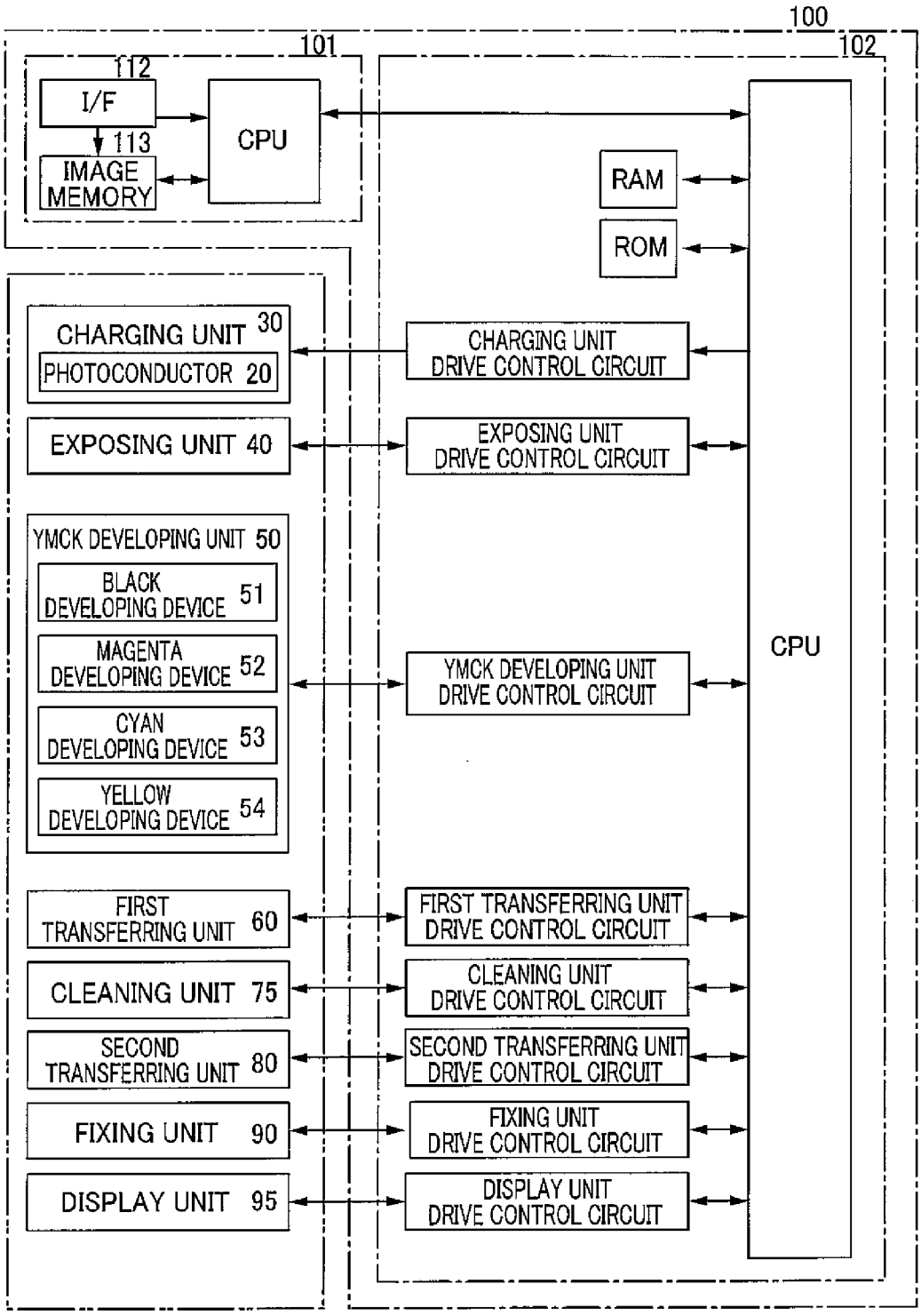
FIG. 2 is a block diagram showing a control unit of the printer 10 in FIG. 1.

The control unit 100 includes a main controller 101 and a unit controller 102 as shown in FIG. 2. An image signal and a control signal are inputted into the main controller 101, and in accordance with a command based on the image signal and the control signal, the unit controller 102 controls the various units, for example, to form the image.

Next, description will be given regarding the operation of the printer 10 configured as above.

First, when image signals and control signals from a host computer (not shown) are inputted to the main controller 101 of the printer 10 via an interface (I/F) 112, the photoconductor 20 and the intermediate transfer body 70 are rotated under the control of the unit controller 102 in accordance with a command from the main controller 101. While rotating, the photoconductor 20 is successively charged by the charging unit 30 at a charging position.

The region of the photoconductor 20 that has been charged is brought to an exposure position through rotation of the photoconductor 20, and a latent image corresponding to image information of a first color, for example yellow Y, is formed in that region by the exposing unit 40. The YMCK developing unit 50 positions the yellow developing device 54, which contains yellow toner (Y), at the developing position opposing the photoconductor 20.

The latent image formed on the photoconductor 20 is brought to the developing position by the rotation of the photoconductor 20, and is developed with yellow toner by the yellow developing device 54. Thus, a yellow toner image is formed on the photoconductor 20.

The yellow toner image that is formed on the photoconductor 20 is brought to the first transferring position through rotation of the photoconductor 20 and is transferred to the intermediate transfer body 70 by the first transferring unit 60. At this time, a first transferring voltage of a polarity that is opposite the toner charge polarity is applied to the primary image transferring unit 60. It should be noted that, during this process, the photoconductor 20 and the intermediate transfer body 70 are in contact, whereas the second transferring unit 80 is kept apart from the intermediate transfer body 70.

By sequentially repeating the above-described processes with each of the developing devices for the second, the third, and the fourth color, toner images in four colors corresponding to the respective image signals are transferred to the intermediate transfer body 70 in a superimposed manner. Thus, a full color toner image is formed on the intermediate transfer body 70.

With the rotation of the intermediate transfer body 70, the full-color toner image formed on the intermediate transfer body 70 reaches a second transferring position, and is transferred onto the medium by the second transferring unit 80. It should be noted that the medium is transported from the paper supply tray 92 to the second transferring unit 80 via a paper supply roller 94 and registration rollers 96. Also, during the image transfer operation, the second transferring unit 80 is pressed against the intermediate transfer body 70 while applying a second transferring voltage to it.

The full-color toner image transferred onto the medium is heated and pressurized by the fixing unit 90 and thus fused to the medium.

Meanwhile, after the photoconductor 20 passes by the first transferring position, the toner adhering to the surface of the photoconductor 20 is scraped off by the cleaning blade 76 that is supported by the cleaning unit 75, and the photoconductor 20 is prepared for charging for the next latent image to be formed. The scraped-off toner is collected into a remaining-toner collector of the cleaning unit 75.

Overview of the Control Unit

Next, description will be given regarding the configuration of the control unit 100 with reference to FIG. 2. The main controller 101 of the control unit 100 is electrically connected to the host computer via the interface 112, and is provided with an image memory 113 for storing image signals inputted into it from the host computer. The unit controller 102 is electrically connected to each of the units of the apparatus body (i.e., the charging unit 30, the exposing unit 40, the YMCK developing unit 50, the first transferring unit 60, the cleaning unit 75, the second transferring unit 80, the fixing unit 90, and the display unit 95), detects the state of the units by receiving signals from sensors provided in those units, and controls each of the units in accordance with the signals that are inputted from the main controller 101.

Configuration Example of the Developing Device

Figure 3:
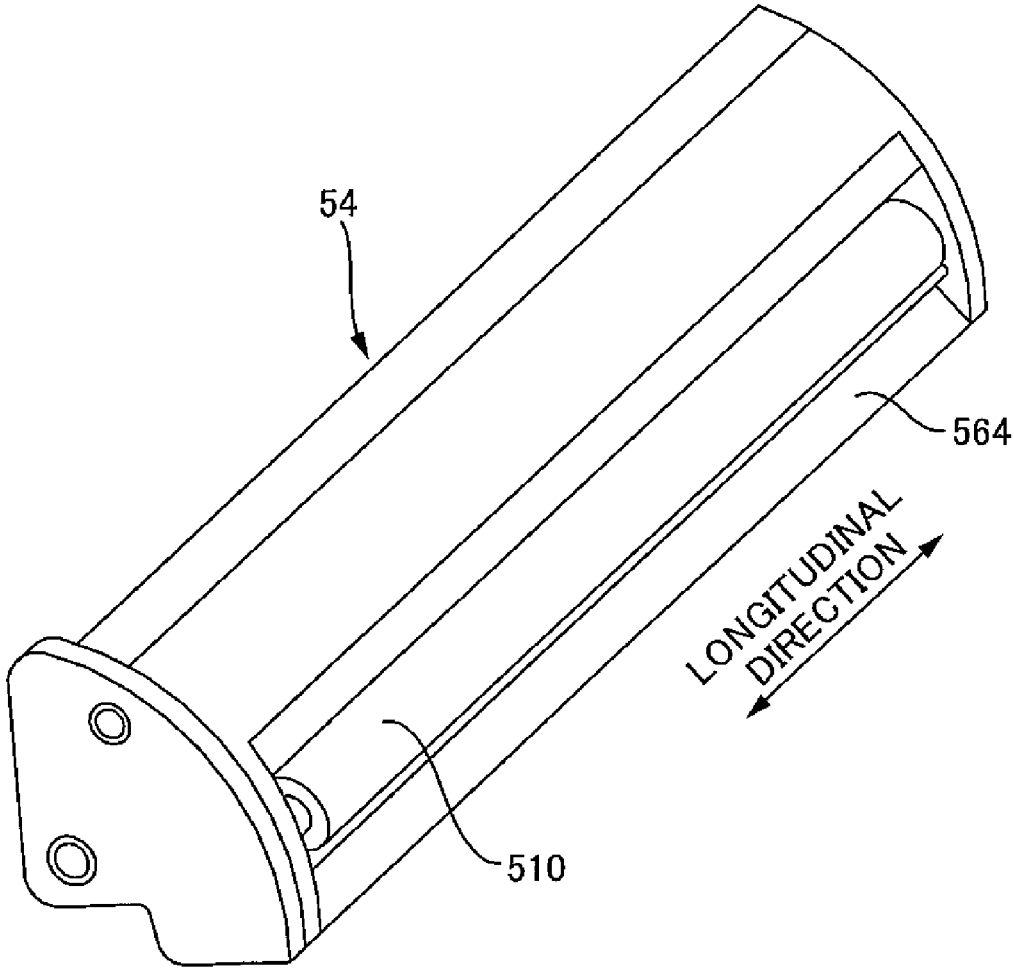
FIG. 3 is a schematic diagram of a developing device.
Figure 4:
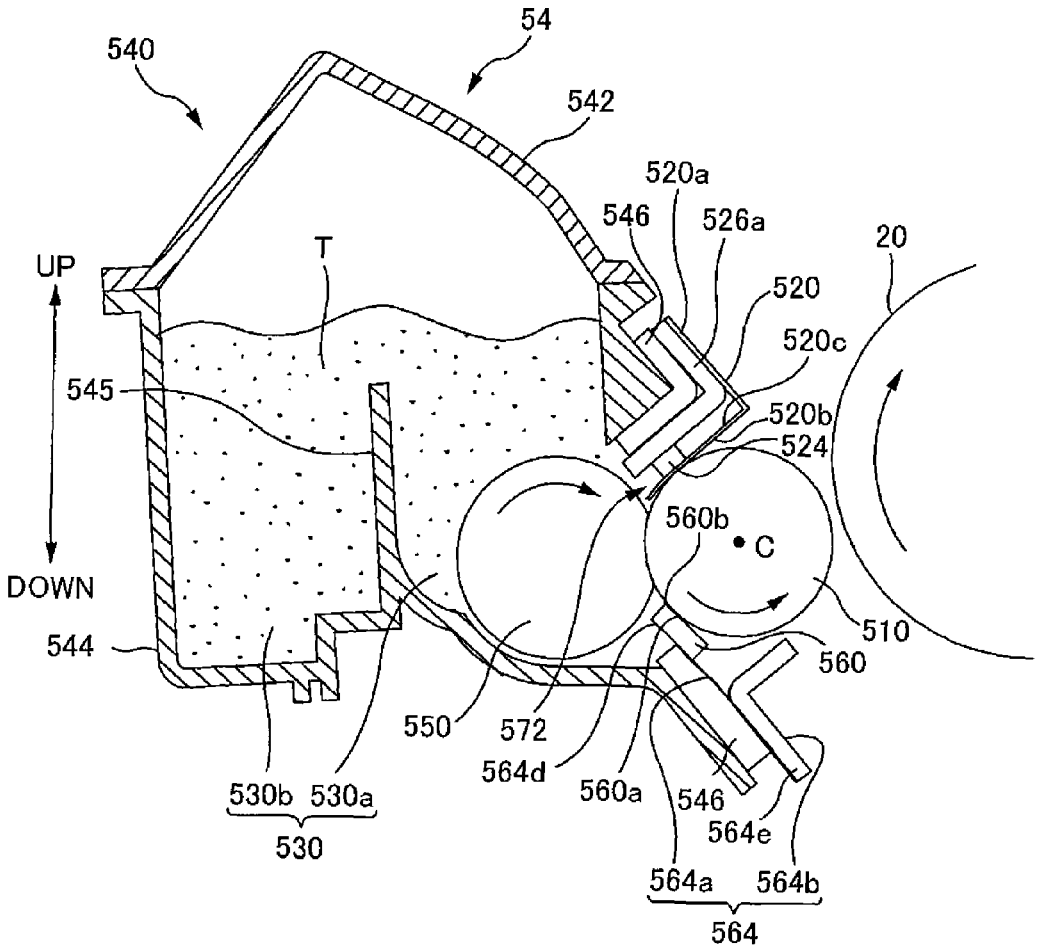
FIG. 4 is a cross-sectional view showing the main structural components of this developing device.
Figure 5:
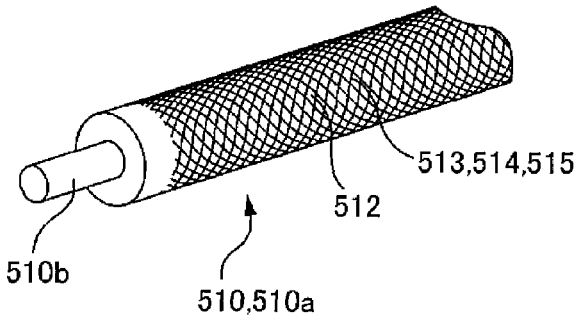
FIG. 5 is a perspective schematic diagram of a developing roller 510.
Figure 6:
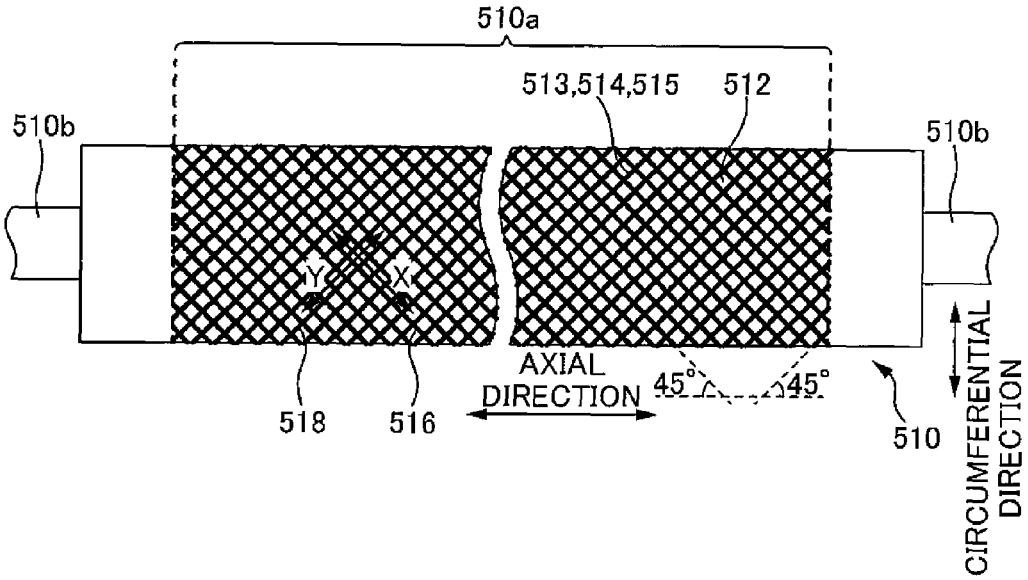
FIG. 6 is a front schematic diagram of the developing roller 510.
Figure 7:
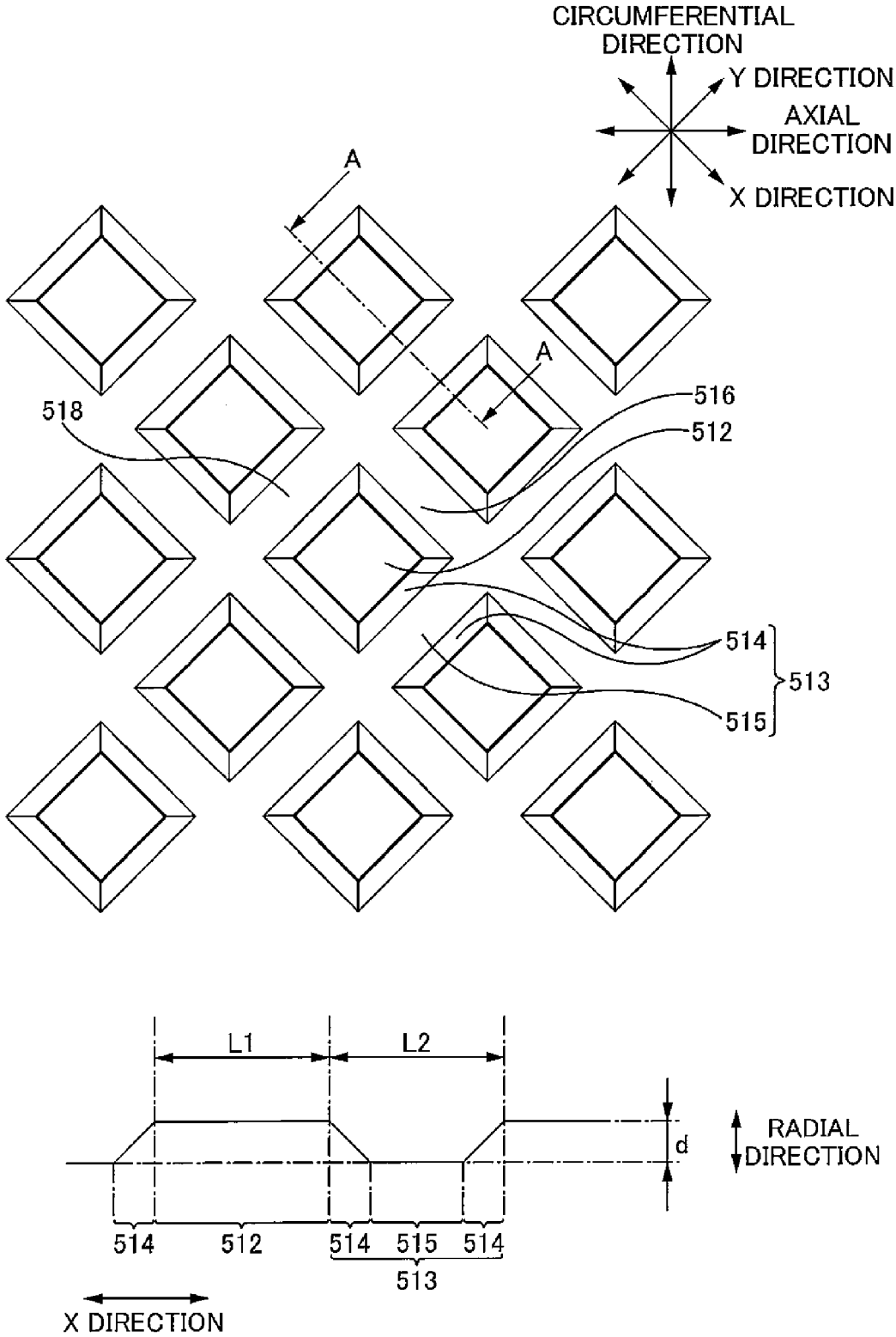
FIG. 7 is a schematic diagram showing shapes including projection sections 512 and depressed sections 515.
Figure 8:
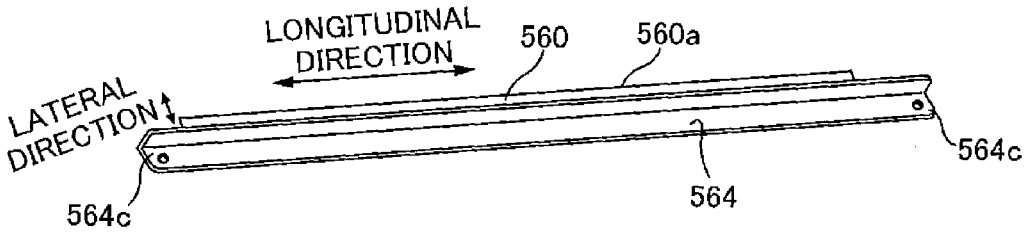
FIG. 8 is a perspective view of a regulation blade 560 and a blade support member 564.
Figure 9:
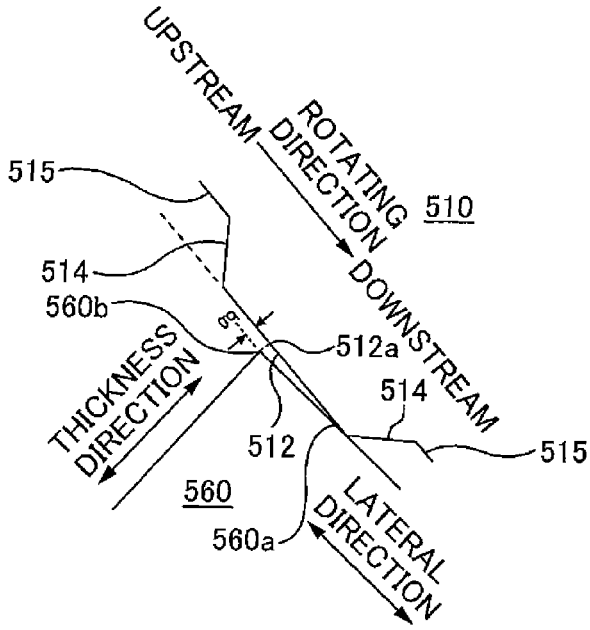
FIG. 9 is an enlarged schematic diagram showing a state near a leading edge 560*b* of the regulation blade 560 that comes into contact with the developing roller 510.
Figure 10:
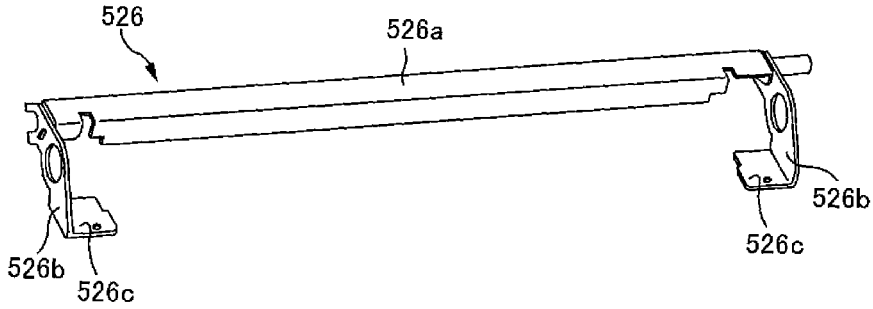
FIG. 10 is a perspective view of a holder 526.
Figure 11:
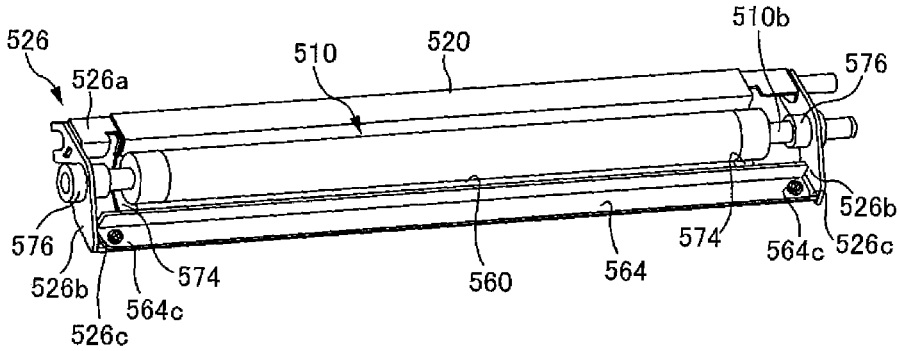
FIG. 11 is a perspective view illustrating the holder 526 to which an upper seal 520, the developing roller 510, the regulation blade 560, and the blade support member 564 are attached in an assembled manner.
Figure 12:
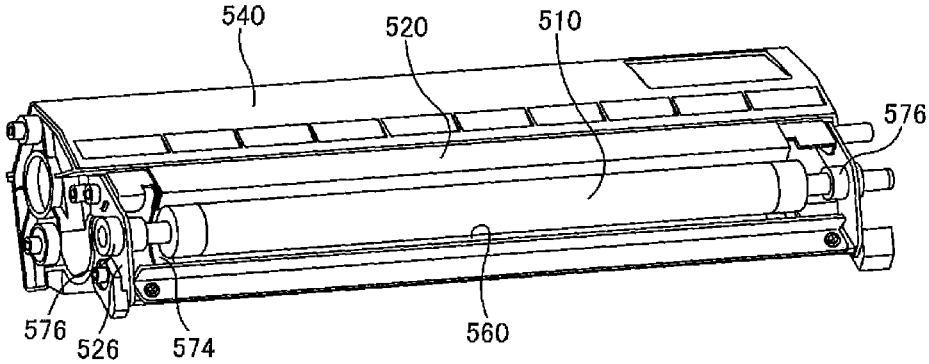
FIG. 12 is a perspective view illustrating the holder 526 attached to a housing 540.

Next, description will be given regarding a configuration example of the developing devices using FIG. 3 to FIG. 12. FIG. 3 is a schematic diagram of a developing device. FIG. 4 is a cross-sectional view showing the main structural components of this developing device. FIG. 5 is a perspective schematic diagram of a developing roller 510. FIG. 6 is a front schematic diagram of the developing roller 510. FIG. 7 is a schematic diagram showing shapes including projection sections 512 and depressed sections 515, and the lower diagram in FIG. 7 shows a cross-sectional shape of an A-A cross section in the upper diagram of FIG. 7. FIG. 8 is a perspective view of a regulation blade 560 and a blade support member 564. FIG. 9 is an enlarged schematic diagram showing a state near a leading edge 560*b* of the regulation blade 560 that comes into contact with the developing roller 510. FIG. 10 is a perspective view of a holder 526. FIG. 11 is a perspective view illustrating the holder 526 to which an upper seal 520, the developing roller 510, the regulation blade 560, and the blade support member 564 are attached in an assembled manner. FIG. 12 is a perspective view illustrating the holder 526 attached to a housing 540. It should be noted that the cross-sectional view shown in FIG. 4 shows a cross section of the developing device taken along a plane perpendicular to the longitudinal direction shown in FIG. 3. Moreover, in FIG. 4, as in FIG. 1, the vertical direction is indicated by arrows, and for example the central shaft of the developing roller 510 is in a lower position than the central shaft of the photoconductor 20. Also, in FIG. 4, the yellow developing device 54 is shown positioned at the developing position, which is in opposition to the photoconductor 20. Furthermore, in FIG. 5 to FIG. 7, and FIG. 9, the projection sections 512 and the like are not to scale in order to make the diagrams easier to understand. Furthermore, the longitudinal direction and the lateral direction of the regulation blade 560 in FIG. 8 and the lateral direction and the thickness direction of the regulation blade 560 in FIG. 9 are shown with arrows respectively.

The YMCK developing unit 50 is provided with the black developing device 51 containing black toner (K), the magenta developing device 52 containing magenta toner (M), the cyan developing device 53 containing cyan toner (C), and the yellow developing device 54 containing yellow toner (Y). However, since the configuration of each of the developing devices is the same, only the yellow developing device 54 will be described below.

The yellow developing device 54 includes the developing roller 510, which is an example of a toner bearing member (toner bearing roller), the upper seal 520, a toner container 530, the housing 540, a toner supply roller 550, the regulation blade 560, which is an example of a regulation member, the holder 526 and the like.

The developing roller 510 bears toner T and transports it by rotating to the developing position opposite the photoconductor 20, and develops the latent image borne on the photoconductor 20 using the toner T (the toner T that is borne on the developing roller 510). The developing roller 510 is a member made of an aluminum alloy or iron alloy or the like.

The developing roller 510 includes the projection sections 512 and non-projection sections 513 on a surface of its central area 510*a*, and the non-projection sections 513 are provided with lateral sections 514 and the depressed sections 515. As shown in FIG. 5 to FIG. 7, these are arranged regularly on the surface of the developing roller 510.

It should be noted that in the present embodiment, each of the projection sections 512 and the non-projection sections 513 (the lateral sections 514 and the depressed sections 515) functions as a toner bearing member for bearing the toner T. And the developing roller 510 develops the latent image that is borne on the photoconductor 20 using the toner T borne on the projection sections 512, the lateral sections 514, and the depressed sections 515.

The projection sections 512 are the highest areas within the central area 510*a*, and have flat top surfaces in a square shape as shown in the upper diagram of FIG. 7. A length L1 of one side of the square projection sections 512 is approximately 50 μm (see lower diagram in FIG. 7). The projection sections 512 are formed on the surface of the central area 510*a* so that the two diagonals of the square shapes run along the rotation-axis direction and the circumferential direction of the developing roller 510 respectively.

In the present embodiment, the non-projection sections 513 are constituted by a first groove portion 516 and a second groove portion 518 that wind around the developing roller in different directions. Here, the first groove portion 516 is a spiral groove whose longitudinal direction runs along a direction shown by reference symbol X in FIG. 6, and the second groove portion 518 is a spiral groove whose longitudinal direction runs along a direction shown by reference symbol Y in FIG. 6. Thus, the first groove portions 516 and the second groove portions 518 intersect each other to form a grid shape and the projection sections 512 are surrounded by the first groove portions 516 and the second groove portions 518. It should be noted in regard to both the groove portions that the acute angles formed by their longitudinal direction and the rotation-axis direction of the developing roller 510 are approximately 45 degrees (see FIG. 6). A groove width L2 of the groove portions (in other words, a distance between adjacent projection sections 512 as shown in the lower diagram in FIG. 7) is approximately 50 μm, which is the same as the length L1 of one side of the projection sections 512.

The lateral sections 514 are slanted surfaces connecting the projection sections 512 and the depressed sections 515, and as shown in the upper diagram of FIG. 7, four lateral sections 514 are provided in correspondence with the four sides of the above-described square projection sections 512. And as shown in FIG. 5 to FIG. 7, many instances of (groups of) the projection section 512 and the four lateral sections 514 are arranged regularly in a meshed-manner on the surface of the central area 510*a* of the developing roller 510.

The depressed sections 515 correspond to the bottom portions of the non-projection sections 513 (namely, the first groove portions 516 and the second groove portion 518), and are the lowest areas of the central area 510*a*. As shown in FIG. 5 to FIG. 7, the depressed sections 515 are formed regularly in a meshed-manner surrounding the projection sections 512 and the four lateral sections 514 on all four sides. It should be noted that, as shown in FIG. 7, a depth d of the depressed sections 515 (the non-projection sections 513) in reference to the projection sections 512 (a length from the projection sections 512 to the depressed sections 515 in the radial direction of the developing roller 510) is approximately 8 μm. In the developing roller 510, the projection sections 512 and the depressed sections 515 are formed so that the depth d is uniform between all the depressed sections 515 provided in the developing roller 510. In the present embodiment, the toner T is granular (particulate) and the volume mean particle size of the toner T is approximately 4.6 μm, and therefore the size of the volume mean particle size of the toner T is smaller than the depth d of the depressed sections 515.

Further still, the surface of the central area 510*a*, which is provided with the above-described projection sections 512, lateral sections 514, and depressed sections 515, is subjected to electroless Ni—P plating.

Furthermore, the developing roller 510 is provided with a shaft section 510*b*, and the developing roller 510 is rotationally supported as a result of the shaft section 510*b* being supported via bearings 576 by developing roller supporting sections 526*b* of the holder 526, which are described later (FIG. 11). As shown in FIG. 4, the developing roller 510 rotates in a direction (the counterclockwise direction in FIG. 4) that is opposite to the rotating direction of the photoconductor 20 (the clockwise direction in FIG. 4).

Moreover, in the state in which the yellow developing device 54 opposes the photoconductor 20, there is a gap between the developing roller 510 and the photoconductor 20. That is, the yellow developing device 54 develops the latent image that has been formed on the photoconductor 20 in a non-contact state in which the toner T borne on the developing roller 510 is not contacting the photoconductor 20.

The housing 540 is manufactured by welding together a plurality of integrally-molded housing sections made of resin, namely, an upper housing section 542 and a lower housing section 544. A toner containing member 530 for containing toner T is formed inside the housing 540. The toner containing member 530 is divided by a partitioning wall 545 for partitioning the toner T, which protrudes inwards (in the vertical direction of FIG. 4) from the inner wall, into two toner containing sections, namely, a first toner containing section 530*a* and a second toner containing section 530*b*. The first toner containing section 530*a* and the second toner containing section 530*b* are in communication at the upper portion, and in the state shown in FIG. 4, the movement of toner T is regulated by the partitioning wall 545. Moreover, as shown in FIG. 4, the housing 540 (that is, the first toner containing section 530*a*) has an aperture 572 at its lower portion, and the developing roller 510 is arranged so that it faces this aperture 572.

The toner supply roller 550 is disposed on the above-mentioned first toner containing section 530*a* and supplies the toner T contained in the first toner containing section 530*a* to the developing roller 510. The toner supply roller 550 is made of polyurethane foam, for example, and comes into contact with the developing roller 510 in a state of elastic deformation. The toner supply roller 550 can rotate around its center axis, and by rotating, it transports the toner T to the contact position where it comes into contact with the developing roller 510. Then, at the contact position, the toner T is frictionally charged by the toner supply roller 550 and the developing roller 510, and the thus-charged toner T adheres to the developing roller 510 and is appropriately borne on the developing roller 510. In this manner, the toner supply roller 550 supplies the toner T to the developing roller 510.

It should be noted that the toner supply roller 550 rotates in a direction (the clockwise direction in FIG. 4) that is opposite the rotating direction of the developing roller 510 (the counterclockwise direction in FIG. 4). Furthermore, the toner supply roller 550 not only has the function to supply the toner T to the developing roller 510, but also the function to scrape off the toner T that has remained on the developing roller 510 after the development from the developing roller 510.

The upper seal 520, which comes into contact with the developing roller 510 along its rotation-axis direction, allows the movement of toner T that has remained on the developing roller 510 after passing the developing position into the housing 540 and restricts the movement of toner T inside the housing 540 out of the housing 540. This upper seal 520 is a seal made of polyethylene film or the like. The upper seal 520 is supported by an upper seal supporting section 526*a* of the holder 526 described later, and is disposed so that its longitudinal direction runs along the rotation-axis direction of the developing roller 510 (FIG. 11).

Furthermore, an upper seal biasing member 524 made of an elastic member such as Moltopren is provided in a compressed state between the upper seal support section 526*a* and the surface of the upper seal 520 that is on the opposite side to a contact surface 520*b* contacting the developing roller 510 (this surface is also referred to as "opposite surface 520*c*")). The upper seal biasing member 524 presses the upper seal 520 against the developing roller 510 by pressing the upper seal 520 toward the developing roller 510 with its biasing force.

The regulation blade 560 comes into contact with the developing roller 510 at a contact section 560*a* so that the longitudinal direction of the regulation blade 560 runs along the rotation-axis direction of the developing roller 510 from one end portion to the other end portion in the rotation-axis direction of the developing roller 510, and regulates the amount of the toner T borne on the developing roller 510 (the projection sections 512 and the non-projection sections 513), and moreover, it applies a charge to the toner T borne on the developing roller 510.

The regulation blade 560 is made of a silicone rubber or a urethane rubber or the like, and as shown in FIG. 4 and FIG. 8, it is supported by the blade support member 564. The blade support member 564 consists of a thin plate 564*a* and a thin plate support section 564*b*, and supports the regulation blade 560 at its one side 564*d* in its lateral direction (that is, on the side of the thin plate 564*a* side). The thin plate 564*a* is made of phosphor bronze or stainless steel or the like and has spring properties. The thin plate 564*a* directly supports the regulation blade 560 and presses the regulation blade 560 with its biasing force against the developing roller 510 (the pressing force of the regulation blade 560 is approximately 0.3 gf/mm). The thin plate support section 564*b* is a metal plate that is arranged on the other side 564*e* in the lateral direction of the blade support member 564, and this thin plate support section 564*b* is attached to the thin plate 564*a* in a state in which it is supported at the edge of the thin plate 564*a* that is opposite from the side that supports the regulation blade 560. The regulation blade 560 and the blade support member 564 are attached to regulation blade support sections 526*c* with longitudinal direction end portions 564*c* of the thin plate support section 564*b* being supported by the regulation blade support sections 526*c* of the holder 526 described later.

Furthermore, as shown in FIG. 9, the regulation blade 560 is disposed so that its leading edge 560*b* in the lateral direction and thickness direction of the regulation blade 560 faces the upstream side of the developing roller 510 in the rotating direction. That is, the regulation blade 560 is in so-called counter contact.

Furthermore, as shown in FIG. 9, the leading edge 560*b* does not come into contact with the developing roller 510, and the contact section 560*a* that does come into contact with the developing roller 510 is positioned at a position apart from the leading edge 560*b*. Further still, in the present embodiment, a distance g from the leading edge 560*b* to the projection sections 512 in the case where the leading edge 560*b* faces the projection sections 512 among the projection sections 512 and the depressed sections 515 of the rotating developing roller 510 (FIG. 9 shows this state, that is, a state in which the developing roller 510 rotates and the leading edge 560*b* comes into a position opposite the projection sections 512, and the area opposite the top of the projection sections 512 is indicated with the reference symbol 512*a*) is extremely small (in other words, if a virtual line is drawn from the leading edge 560*b* toward the cross-sectional center of the developing roller 510 shown in FIG. 4 with the reference symbol C, the distance g corresponds to a length of the virtual line from the leading edge 560*b* to where it intersects the projection sections 512). More specifically, the distance g is approximately 2 μm, which is a value smaller than the volume mean particle size of the toner T (approximately 4.6 μm).

Furthermore, as shown in FIG. 11, an end portion seal 574 is provided on a longitudinal direction outer side of the regulation blade 560. The end portion seal 574 is made up of a nonwoven fabric, and contacts the developing roller 510 along the circumferential surface thereof at the end portion in the rotation-axis direction thereof, so as to perform a function to prevent leakage of the toner T from a space between the circumferential surface and the housing 540.

The holder 526 is a metal member on which various members such as the developing roller 510 are assembled. As shown in FIG. 10, it includes the upper seal support section 526*a* disposed along the longitudinal direction of the holder 526 (namely, the rotation-axis direction of the developing roller 510), the developing roller support sections 526*b* that are provided on the outside in the longitudinal direction (the rotation-axis direction) of the upper seal support section 526*a* and intersect the longitudinal direction (the rotation-axis direction), and the regulation blade support sections 526*c* that intersect the developing roller support sections 526*b* and face the end portion in the longitudinal direction of the upper seal support section 526*a*.

As shown in FIG. 11, the upper seal 520 is supported by the upper seal support section 526*a* at a lateral direction end portion 520*a* thereof (FIG. 4), and the developing roller 510 is supported by the developing roller support sections 526*b* at its ends.

Further still, the regulation blade 560 and the blade support member 564 are supported by the regulation blade support sections 526*c* at the longitudinal direction end portions 564*c* of the blade support member 564. The regulation blade 560 and the blade support member 564 are secured to the holder 526 by being screwed into the regulation blade support sections 526*c*.

In this manner, the holder 526 on which the upper seal 520, the developing roller 510, the regulation blade 560, and the blade support member 564 are attached in an assembled manner, is attached to the above-described housing 540 via a housing seal 546 (FIG. 4) for preventing leakage of the toner T from between the holder 526 and the housing 540, as shown in FIG. 12.

In the yellow developing device 54 configured in this manner, the toner supply roller 550 supplies the toner T contained in the toner container 530 to the developing roller 510. During supply the toner T is frictionally charged by the toner supply roller 550 and the developing roller 510, and the thus-charged toner T adheres to the developing roller 510 and is appropriately borne on the developing roller 510. The toner T borne on the developing roller 510 reaches the regulation blade 560 along with rotation of the developing roller 510, then the amount of the toner T is regulated by the regulation blade 560 and the toner T is further frictionally charged. The toner T on developing roller 510 is brought to the developing position in opposition to the photoconductor 20 due to further rotation of the developing roller 510, and is supplied for developing the latent image formed on the photoconductor 20 in an alternating electric field at the developing position. The toner T on the developing roller 510 that has passed the developing position due to further rotation of the developing roller 510 passes the upper seal 520 and is collected in the developing device without being scraped off by the upper seal 520. Moreover, the toner T that is still remaining on the developing roller 510 is scraped off by the toner supply roller 550.

Mechanism of Development Memory Occurrences

Figure 13:
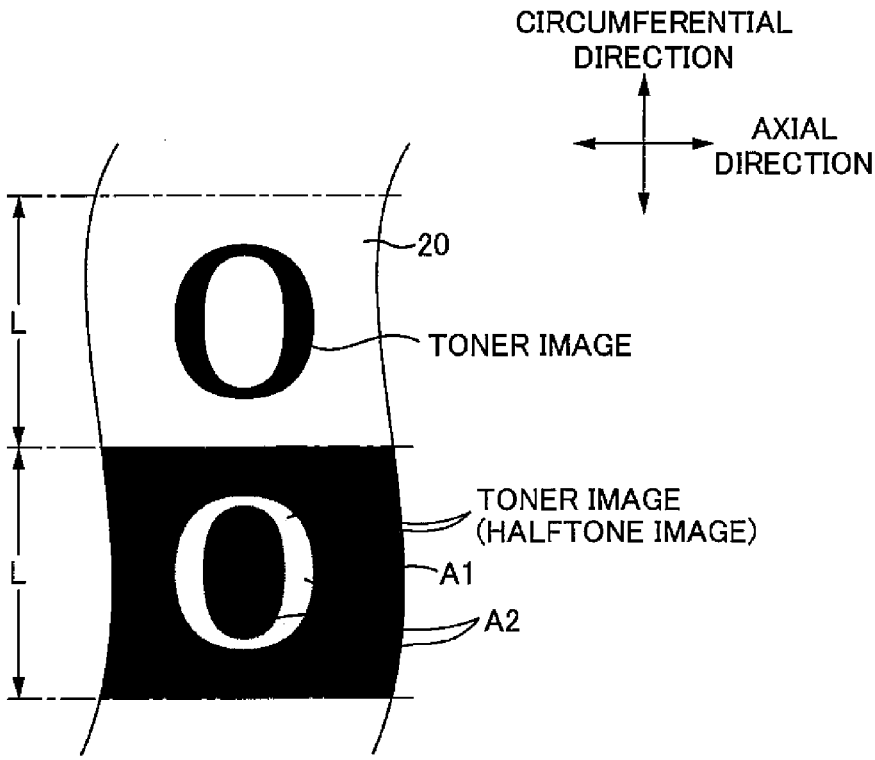
FIG. 13 is an explanatory diagram for describing a mechanism of development memory occurrences.

As already described, in the case where toner having a slow electrical-charge buildup (toner that takes time for its charging amount to reach a saturated charge amount) is used in the printer 10, a phenomenon known as so-called development memory can occur due to the slowness of the electrical-charge buildup. Here, description will be given regarding a mechanism of development memory occurrences using FIG. 13. FIG. 13 is an explanatory diagram for describing a mechanism of development memory occurrences.

As described earlier, the toner is frictionally charged due to the toner supply roller 550 and the developing roller 510, and the thus-charged toner adheres to the developing roller 510 and is borne on the developing roller 510. Then, the toner borne on the developing roller 510 reaches the developing position that opposes the photoconductor 20 after being further frictionally charged by the regulation blade 560, and is supplied for the development of the latent image at the developing position. That is, the following processes that are executed while the developing roller 510 performs one revolution, namely a process of charging and supplying toner using the toner supply roller 550 (causing toner to be borne on the developing roller 510), a process of charging the toner using the regulation blade 560, and a process of developing the latent image on the photoconductor 20, are executed a plurality of times by the developing roller 510 performing a plurality of revolutions. Then, for example, a toner image formed on the photoconductor 20 by executing the aforementioned series of processes in an n-th revolution of the developing roller 510, and a toner image formed on the photoconductor 20 by executing the aforementioned series of processes in an (n+1)-th revolution of the developing roller 510, become lined up in the circumferential direction of the photoconductor 20.

Here, in the present section we will examine the aforementioned processing of the developing roller 510 in a case involving a latent image expressing the alphabet letter "O" being developed and a toner image expressing the alphabet letter "O" being formed on the photoconductor 20 by executing the aforementioned series of processes in the n-th revolution of the developing roller 510, and a halftone image being formed on an entire surface of the photoconductor 20 by developing a latent image as a result of executing the aforementioned series of processes in the (n+1)-th revolution of the developing roller 510. And by examining this, a mechanism of development memory occurrences will be clarified.

When developing the latent image that expresses the alphabet letter "O" in the aforementioned development processing in the n-th revolution of the developing roller 510, of the toner borne on the developing roller 510, it is the toner borne on the developing roller 510 in the portions facing the latent image that is consumed so as to form a toner image. For this reason, after the completion of the development processing in the n-th revolution of the developing roller 510, this facing portion no longer bears toner. Conversely, toner that is borne on the developing roller 510 in portions not facing the latent image are not consumed, and therefore toner is still borne in these non-facing portions after the completion of the development processing. After the aforementioned series of processes in the n-th revolution of the developing roller 510 finished in this manner, a first region in which toner is not borne (this first region is shaped as the letter "O") and a second region in which toner is borne are produced on the developing roller 510.

Then, due to the developing roller 510 rotating, the first region and the second region eventually reach the contact position that is in contact with the toner supply roller 550, and the aforementioned series of processes in the (n+1)-th revolution of the developing roller 510 commences. In other words, at the contact position, the process of charging and supplying toner is executed using the (n+1)-th revolution of the toner supply roller 550.

Here, toner is already being borne in the second region, and this toner is in a sufficiently charged state due to the execution of the process of charging and supplying toner using the toner supply roller 550 in the n-th revolution and the process of charging the toner using the regulation blade 560 in the n-th revolution. Then, (without being scraped off by the toner supply roller 550) this toner is even further charged by executing this processing, and therefore the adhesiveness by which the toner adheres to the developing roller 510 is further increased. Consequently, while continuing to be borne on the developing roller 510, this toner is transported toward the regulation blade 560 so as to execute the next processing.

Conversely, since toner is not borne in the first region, toner that is contained in the toner container 530 is freshly supplied to the first region. The toner here is different from the second region toner, which is sufficiently charged due to the execution of the toner charging process in the n-th revolution, and its charge is insufficient. Then, in this processing, the toner is frictionally charged by the toner supply roller 550 and the developing roller 510, but in the case where the toner has a property of a slow electrical-charge buildup (where it takes time for the charging amount of the toner to reach a saturated charge amount), toner will not be appropriately borne on the developing roller 510 during being frictionally charged (it can also be said that the supply of toner by the toner supply roller 550 in the first region is not executed sufficiently).

Then, the first region, in which toner is not appropriately borne, and the second region, in which toner is appropriately borne, reach the regulation blade 560 so as to execute the process of charging the toner using the regulation blade 560 in the (n+1)-th revolution, after which they arrive at the developing position facing the photoconductor 20. Here, a halftone image is formed on the entire surface of the photoconductor 20 by executing the development processing of the (n+1)-th revolution and developing the latent image, but although the toner is borne appropriately in the second region, the toner is not borne appropriately in the first region, and therefore the density of the halftone image formed by developing the latent image facing the first region is lighter than the density of the halftone image formed by developing the latent image facing the second region.

This condition (a difference between the two densities) is shown in FIG. 13. FIG. 13 shows a toner image expressing the alphabet letter "O" formed on the photoconductor 20 by executing the aforementioned series of processes in the n-th revolution of the developing roller 510, and a halftone image formed on the photoconductor 20 by executing the aforementioned series of processes in the (n+1)-th revolution of the developing roller 510. In FIG. 13, the toner images formed on the photoconductor 20 are shown on the circumferential surface of the photoconductor 20, which is schematically extended, and the circumferential direction and the axial direction of the photoconductor 20 are indicated with arrows. The length L indicated in FIG. 13 corresponds to a length of one revolution of the circumferential surface of the developing roller 510.

And FIG. 13 shows a condition in which the density of the halftone image formed by developing the latent image facing the first region (indicated in FIG. 13 with the reference symbol A1) is lighter than the density of the halftone image formed by developing the latent image facing the second region (indicated in FIG. 13 with the reference symbol A2). Also, since the first region is shaped as the letter "O" as mentioned earlier, the lighter density halftone image that is formed by developing the latent image facing the first region is also shaped as the letter "O". That is, a phenomenon, namely, development memory, occurs in which a form of the toner image, which has been formed on the photoconductor 20 by executing the aforementioned series of processes in the n-th revolution, appears on the halftone image that is formed on the photoconductor 20 by executing the aforementioned series of processes in the (n+1)-th revolution.

In the case where a toner having a slow electrical-charge buildup is used in the printer 10 in this manner, development memory caused by this slowness of the electrical-charge buildup can occur conspicuously.

Conversely, in the case where a toner having a fast electrical-charge buildup is used, the toner is appropriately borne on the developing roller 510 in the first region also while the toner is frictionally charged by the toner supply roller 550 and the developing roller 510 in the process of charging and supplying toner in the (n+1)-th revolution, and therefore the density of the halftone image formed by developing the latent image facing the first region and the density of the halftone image formed by developing the latent image facing the second region are substantially equivalent. Thus, in this case, occurrences of development memory are inhibited.

Regarding the Toner Structure According to the Present Embodiment and the Relationship between the Toner Structure and Extent of Development Memory Occurrences As mentioned earlier, in the case where toner having a slow electrical-charge buildup is used in the printer 10, development memory caused by this slowness of the electrical-charge buildup can occur conspicuously. And since the speed of the toner electrical-charge buildup is linked to the structure of the toner, there is a regular relationship between the toner structure and the extent of development memory occurrences.

Here, description will be given first regarding the structure of the toner according to the present embodiment, that is, the toner used in the printer 10 according to the present embodiment. Then, following this, we examine the relationship between the structure of the toner according to the present embodiment and the extent of development memory occurrences.

Regarding the Structure of Toner According to the Present Embodiment

1) Regarding Toner Particle Size

In regard to the toner used in the printer 10 according to the present embodiment, in giving importance to achieving excellent image quality for the images to be finally obtained (improving dot reproducibility), the toner particle size is set smaller than the toner particle size (larger than a volume mean particle size of 5 μm) that has been used in general conventionally (that is, the volume mean particle size here is not greater than 5 μm). More specifically, as mentioned earlier, its volume mean particle size Ave is approximately 4.6 μm. Furthermore, a 3σ value, namely a value obtained by subtracting 3 times a standard deviation a in the toner particle size distribution from the volume mean particle size Ave (hereinafter referred to as a "minus 3σ value" for the sake of convenience), and a value obtained by adding 3 times the standard deviation a in the toner particle size distribution to the volume mean particle size (hereinafter referred to as a "plus 3σ value" for the sake of convenience) are approximately 2.3 μm and approximately 6.9 μm respectively.

It should be noted that the volume mean particle size is a value calculated by a sum total of the products of Ri and Pi from i=1 to n under a condition in which volume occupation rates of toner of particle sizes Ri (i=1 to n) are respectively Pi (i=1 to n, the sum total from P1 to Pn is 1). Furthermore, the standard deviation σ is a square root of dispersion, and the dispersion is a value calculated by a sum total of the products of the square values of a difference between Ri (i=1 to n) and Ave, and Pi from i=1 to n.

2) Regarding the Degree of Circularity of the Toner

In giving importance to transferability in first transferring and second transferring for the toner used in the printer 10 according to the present embodiment, the degree of circularity of the toner is greater (approaching a perfect circle, and where the degree of circularity is equal to or more than 0.950) than the degree of circularity of toner that is used in conventional cases (where the degree of circularity is equal to or less than 0.950). More specifically, the degree of circularity is approximately 0.960 to 0.985.

3) Regarding the Charge Control Agent (CCA)

The toner used in the printer 10 according to the present embodiment does not contain a charge control agent (CCA).

Typical toner manufacturing methods include pulverization techniques and polymerization techniques, but since the polymerization techniques are more suited to the manufacture of small particle size toner and to the manufacture of toner having a high degree of circularity, the toner according to the present embodiment is manufactured using a polymerization technique. And since there is a possibility of difficulties occurring if a charge control agent (CCA) is included in the case where a polymerization technique is used as the toner manufacturing method, in the present embodiment, the toner does not contain a charge control agent (CCA).

It should be noted that examples of polymerization techniques that can be put forth include suspension polymerization and emulsion polymerization. In the suspension polymerization technique, a coloring toner particle having a desired particle size can be formed by adding while agitating a monomer composite, in which a polymerizable monomer, a coloring agent (coloring pigment), a release agent, and further as required, a dye, a polymerization initiator, a cross-linking agent, and other additives have been dissolved or dispersed, to an aqueous phase containing a suspension stabilizer (a water-soluble macromolecule and a poorly water-soluble inorganic substance), then causing granulation and polymerization. In the emulsion polymerization technique, for example, a coloring toner particle having a desired particle size can be formed by dispersing a monomer and a release agent, and further as required, a polymerization initiator, an emulsifying agent (a surface-active agent) or the like, in water and carrying out polymerization, then adding a coloring agent (coloring pigment) and an agglutination agent (an electrolyte) or the like in an agglutination process.

The toner according to the present embodiment is manufactured using an emulsion polymerization technique, and hereinafter description will be given regarding a manufacturing method based on an emulsion polymerization technique for the cyan toner of the aforementioned toners of four colors (black toner, magenta toner, cyan toner, and yellow toner).

First, a monomer mixture, which is constituted by 80 parts by mass styrene monomer, which is a monomer, 20 parts by mass butyl acrylate, and 5 parts by mass acrylic acid, is added to an aqueous mixture of 105 parts by mass water, 1 part by mass nonionic emulsifying agent (Emulgen 950 produced by Dai-ichi Kogyo Seiyaku), 1.5 parts by mass anionic emulsifying agent (Neogen R produced by Dai-ichi Kogyo Seiyaku), and 0.55 parts by mass potassium persulfate, which is a polymerization initiator, then, while this is agitated in a nitrogen gas stream, it is subjected to polymerization for 8 hours at 70° C. Cooling is performed after the polymerization reaction, thereby obtaining a milk-white resin emulsion having a particle size of 0.25 μm.

Next, 200 parts of the resin emulsion, 20 parts of a polyethylene wax emulsion (produced by Sanyo Chemical Industries Ltd.), which is a release agent, and 25 parts of phthalocyanine blue, which is a coloring agent, are dispersed into 0.2 liters of water containing 0.2 parts sodium dodecylbenzenesulfonate, which is a surface-active agent, then diethylamine is added and the pH is adjusted to 5.5, after which 0.3 parts aluminum sulfate, which is an electrolyte, is added while agitating the mixture, and following this, dispersion is carried out by performing high speed agitation using an agitation device (T.K. HOMO Mixer).

Further still, 40 parts by mass styrene monomer, 10 parts by mass butyl acrylate, and 5 parts by mass zinc salicylate are added along with 40 parts by mass water, and this is heated to 90° C. in a similar manner while being agitated in a nitrogen gas stream, then hydrogen peroxide water is added and polymerization is performed for 3 hours, thereby growing the particles. After polymerization has stopped, the temperature is raised to 95° C. while adjusting the pH to 5 or greater and held there for 5 hours so as to increase the bond strength of the associating particles. After this, the particles obtained are rinsed then subjected to vacuum drying for 10 hours at 45° C., thereby obtaining a cyan toner core particle (coloring toner particle).

By admixing the thus-obtained coloring toner particle and an external additive (specifically, silica and titania), the external additive becomes externally added to the coloring toner particle, and thus obtaining a cyan toner having a volume mean particle size of 4.6 μm.

4) Regarding the Coloring Agent (Coloring Pigment)

Taking the particle size of the toner being small for the toner used in the printer 10 according to the present embodiment into account, the amount of coloring agent (coloring pigment) contained in the toner is greater (namely, not less than 10 wt %) than the amount of coloring agent (coloring pigment) contained in toner that is used in general conventionally (which is less than 10 wt %). That is, in the case where the toner particle size is small, the amount of toner that finally adheres to the medium such as paper is small, and therefore there is a tendency for the density of the image to become lighter. Accordingly, more coloring agent (coloring pigment) is included in the present embodiment in order to compensate for this.

Regarding the Relationship between the Toner Structure and Extent of Development Memory Occurrences The toner according to the present embodiment has properties that were described in numbered sections 1 to 4 above. And due to the toner having these properties, development memory tends to occur easily in the printer 10 according to the present embodiment in which this toner is used.

That is, a decrease in the toner particle size increases the saturated charge amount of the toner, and therefore the toner electrical-charge buildup becomes slower. Furthermore, since the toner does not contain a charge control agent (CCA), charge control for increasing the speed of the toner electrical-charge buildup cannot be implemented. Furthermore, the toner electrical-charge buildup will be slow regardless since there is a large amount of coloring agent (coloring pigment).

Thus, in the printer 10 according to the present embodiment, the toner electrical-charge buildup is slow, and therefore development memory tends to occur easily.

Also, in the case where the degree of circularity of the toner is small, the toner more easily sticks to the developing roller 510, and therefore even if the toner electrical-charge buildup is slow, the aforementioned inappropriateness relating to bearing of toner in the first region is slightly alleviated. For this reason, the difference between the density of the halftone image formed by developing the latent image facing the first region and the density of the halftone image formed by developing the latent image facing the second region becomes very small, thereby somewhat inhibiting occurrences of development memory. However, this can not be expected to help in this situation since the toner according to the present embodiment has a high degree of circularity and consequently occurrences of development memory become more conspicuous in the present embodiment.

Advantageous Effects of the Developing Device According to the Present Embodiment The developing roller 510 provided in the developing device according to the present embodiment is configured to develop latent images in a state in which the projection section covering ratio at which toner contacting the projection sections 512 covers the projection sections 512 is smaller than the depressed section covering ratio at which toner contacting the depressed sections 515 covers the depressed sections 515. With this configuration, the above-stated occurrences of development memory are inhibited, and deterioration in image quality of the finally obtained image is appropriately prevented.

Below, it will be described why the developing roller 510 of the present embodiment develops the latent image in a state in which the projection section covering ratio is smaller than the depressed section covering ratio. After that, it will be described why such a configuration can prevent occurrences of development memory and appropriately prevent deterioration in image quality.

As described earlier, the toner is frictionally charged due to the toner supply roller 550 and the developing roller 510, and the thus-charged toner adheres to the developing roller 510 and is borne on the developing roller 510. The toner borne on the developing roller 510 reaches the regulation blade 560 along with rotation of the developing roller 510, then the amount of the toner is regulated by the regulation blade 560 and the toner is further frictionally charged.

As shown in FIG. 9, the regulation blade 560 according to the present embodiment is arranged so that the leading edge 560*b* faces the upstream side of the developing roller 510 in the rotating direction, and so that a distance g (approximately 2 μm) from the leading edge 560*b* to the projection sections 512 in the case where the leading edge 560*b* faces the projection sections 512 of the rotating developing roller 510 is extremely small (smaller than the toner volume mean particle size (approximately 4.6 μm)). For this reason, when the toner that has been borne on the projection sections 512 has reached the regulation blade 560 due to the rotation of the developing roller 510, the toner that is borne on the projection sections 512 having this volume mean particle size is unable to pass through the (2 μm) gap between the leading edge 560*b* and the opposing area 512*a* (it rebounds upon hitting the leading edge 560*b*), and cannot reach the developing position opposing the photoconductor 20.

Conversely, when the toner borne in the depressed sections 515 is focused on, the toner volume mean particle size (approximately 4.6 μm) is smaller than the depth d of the depressed sections 515 (approximately 8 μm), and therefore the toner that is borne in the depressed sections 515 and has this volume mean particle size is able to pass through the (2 μm) gap between the leading edge 560*b* and the opposing area 512*a* and reaches the developing position opposing the photoconductor 20.

Figure 14:
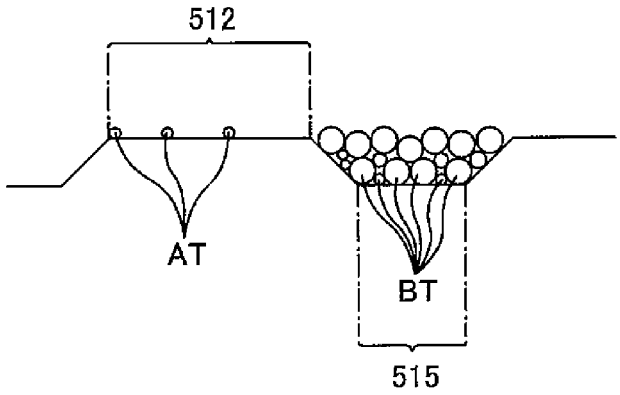
FIG. 14 is a schematic diagram illustrating a state (1) of toner borne on the projection sections 512 and the depressed sections 515 at a developing position.

As a result, in the developing position opposing the photoconductor 20, the state of the toner borne on the projection sections 512 and the depressed sections 515 is, as shown in FIG. 14, a state in which the projection section covering ratio at which toner contacting the projection sections 512 (indicated by the reference symbol "AT" in FIG. 14) covers the projection sections 512 is smaller than the depressed section covering ratio at which toner contacting the depressed sections 515 (indicated by the reference symbol "BT" in FIG. 14) covers the depressed sections 515. Then, the developing roller 510 develops the latent image in a state in which the projection section covering ratio is smaller than the depressed section covering ratio.

Note that the projection section covering ratio (depressed section covering ratio) defined in this section refers to a covering ratio obtained while regarding only the toner that contacts the projection sections 512 (depressed sections 515) of the toner present over the projection sections 512 (depressed sections 515) as "the toner covering the projection sections 512 (depressed sections 515)". For example, as shown in FIG. 14, toner is borne in a plurality of layers on the depressed sections 515, and while a part of the toner contacts the depressed sections 515 (namely, toner indicated by the reference symbol "BT"), other parts of the toner does not contact the depressed sections 515 (namely, toner other than that indicated by the reference symbol "BT"). The depressed section covering ratio is a parameter (a parameter indicating the degree to which the toner covers the depressed sections 515) obtained on the assumption that the toner that covers the depressed sections 515 is the toner that contacts the depressed sections 515 only, in other words, that toner that does not contact the depressed sections 515 is not present.

The projection section covering ratio and the depressed section covering ratio are measured, for example, as described below (although the depressed section covering ratio is used here as an example, substantially the same method is applied to the projection section covering ratio as well). Firstly, of the toner in a plurality of layers borne in the depressed sections 515 at the portion of the developing roller 510 corresponding to the developing position (or portion that has passed by the regulation blade 560), toner other than the toner of the lowermost layer is removed using a tape or the like, thereby putting the developing roller 510 in a state in which only the toner that contacts the depressed sections 515 is borne in the depressed sections 515. Next, the picture of such depressed sections 515 is captured from above by a microscope. From that picture, the area of the portion in the depressed sections 515 covered by the toner is obtained, and such an area is divided by the area of the depressed sections 515 to calculate the depressed section covering ratio.

Then, the projection section covering ratio and the depressed section covering ratio were obtained using the measuring method in the developing device according to the present embodiment using the above-stated toner (toner manufactured by the above-stated manufacturing method). As a result, the projection section covering ratio and the depressed section covering ratio were approximately 10% and 90%, respectively.

FIG. 14 is a diagram illustrating a state of toner borne on the projection sections 512 and the depressed sections 515 at the developing position. FIG. 14 shows a state in which only the toner having an extremely small particle size that could have passed through the (2 μm) gap between the leading edge 560*b* and the opposing area 512*a* is borne on the projection sections 512.

Next, it will be described why occurrences of development memory can be inhibited and deterioration in image quality in images can be appropriately prevented by the developing roller 510 developing the latent image in a state in which the projection section covering ratio is smaller than the depressed section covering ratio.

In the first region where toner is not being borne, which occurs after the completion of the development processing of the n-th revolution of the developing roller 510, toner contained in the toner container 530 is freshly supplied in the process of charging and supplying toner using the toner supply roller 550 in the (n+1)-th revolution. And description has been given regarding a point above that in the case where the toner freshly supplied to the first region is toner having a property of being a toner whose electrical-charge buildup is slow, the toner will not be borne appropriately in the first region of the developing roller 510 during frictional charging carried out by the toner supply roller 550 and the developing roller 510.

Here, the projection sections 512 and the depressed sections 515 are present within the first region, but the extent of inappropriateness relating to bearing of toner in the first region varies depending on which among the projection sections 512 and the depressed sections 515 of the first region the toner is borne. That is, the non-projection sections 513 including the depressed sections 515 are cupped so as to easily accommodate toner, and therefore toner readily enters the non-projection sections 513. And the toner that has entered the non-projection sections 513 is subjected to packing within the non-projection sections 513, and an agglutinative force produced at this time provides an effect of bearing the toner in the depressed sections 515. Consequently, in the depressed sections 515, even if the toner electrical-charge buildup is slow, the aforementioned inappropriateness relating to bearing of toner in the first region is alleviated. In contrast to this, this effect is not obtained for the projection sections 512, and the extent of inappropriateness is smaller in the depressed sections 515 than in the projection sections 512.

For this reason, during the development processing of the (n+1)-th revolution, a difference between the density of the halftone image formed by developing the latent image facing the depressed sections 515 of the first region and the density of the halftone image formed by developing the latent image facing the depressed sections 515 of the second region is smaller than a difference between the density of the halftone image formed by developing the latent image facing the projection sections 512 of the first region and the density of the halftone image formed by developing the latent image facing the projection sections 512 of the second region. In other words, in inhibiting occurrences of development memory, of the projection sections 512 and the depressed sections 515, it is better to as much as possible develop the latent image using toner borne in the depressed sections 515.

Taking such issues into account, in the present embodiment, a configuration is adapted in which the latent image is developed in a state in which the projection section covering ratio at which toner contacting the projection sections 512 covers the projection sections 512 is smaller than the depressed section covering ratio at which toner contacting the depressed sections 515 covers the depressed sections 515. Accordingly, the difference between the density of the halftone image formed by developing the latent image facing the first region and the density of the halftone image formed by developing the latent image facing the second region becomes smaller, compared with the case where, for example, the latent image is developed in a state in which the projection section covering ratio is equal to the depressed section covering ratio, and accordingly occurrences of development memory are inhibited. As a result, deterioration in image quality of the finally obtained image is appropriately prevented. It should be noted that in the above description, a case was described as a comparative example, where the latent image is developed in a state in which the projection section covering ratio is equal to the depressed section covering ratio. In addition, the projection section covering ratio and the depressed section covering ratio were obtained by the above measurement method in a conventional developing device, and the obtained projection section covering ratio and depressed section covering ratio were both approximately 90%. However, in this section, "the projection section covering ratio is equal to the depressed section covering ratio"

means an equal condition while taking measurement errors into account, and does not mean that the both values are exactly the same.

Also, increasing the pressing force of the regulation blade 560 from approximately 0.3 gf/mm (this corresponds to the value of the pressing force in the developing device according to the present embodiment, as described above) to 5 gf/mm makes the projection section covering ratio approximately 0%. In such a case, wear between the regulation blade 560 and the projection sections 512 or the rubbing sound produced as a result of the projection sections 512 rubbing against the regulation blade 560 becomes conspicuous. That is, it is desirable in supressing occurrences of development memory in a further appropriate manner to develop the latent image not with the toner borne on the projection sections 512 and the depressed sections 515, but with the toner borne only in the depressed sections 515 among the projection sections 512 and the depressed sections 515 (specifically, development of the latent image with toner borne on the projection sections 512 is averted by preventing the projection sections 512 from bearing the toner thereon). However, another problem stated above will occur (that is, since a condition can occur in which no toner is present between the regulation blade 560 and the projection sections 512 of the developing roller 510, the lifetime of the regulation blade 560 will be reduced, the rubbing sound produced as a result of the projection sections 512 rubbing against the regulation blade 560 will be louder or the like). Therefore, in the present embodiment, the projection sections 512 are allowed to bear toner, and it is allowed to some extent to develop the latent image with the toner borne on the projection sections 512.

Also as already described, the developing device according to the present embodiment includes the developing roller 510 that can rotate that includes the regularly arranged projection sections 512 and the depressed sections 515, bears a toner whose volume mean particle size is smaller than the depth of the depressed sections 515 in reference to the projection sections 512, and develops the latent image borne on the photoconductor 20 with the toner borne on the developing roller 510, and the regulation blade 560 for regulating the amount of toner borne on the developing roller 510 by contacting the developing roller 510 at the contact section 560*a* in a manner in which the longitudinal direction of the regulation blade 560 runs along the rotation-axis direction of the developing roller 510, in which the leading edge 560*b* in the lateral direction and the thickness direction of the regulation blade 560 is disposed so as to face the upstream side of the developing roller 510 in the rotating direction. Also in the developing device, a distance g from the leading edge 560*b* to the projection sections 512 in the case where the leading edge 560*b* faces the projection sections 512 among the projection sections 512 and the depressed sections 515 is smaller than the volume mean particle size. Therefore, the above-stated occurrences of development memory are inhibited and deterioration in image quality of the finally obtained image is appropriately prevented.

As described above, in the present embodiment the above-stated minus 3σ value related to toner is approximately 2.3 μm, and the distance g (approximately 2 μm) is smaller than this value. The toner particle size distribution of the present embodiment is a substantially normal distribution, and therefore almost all (99% or more) the toner borne on the projection sections 512 cannot pass through the (2 μm) gap between the leading edge 560*b* and the opposing area 512*a*, and cannot reach the developing position opposing the photoconductor 20. Accordingly, the present embodiment can further suppress occurrences of development memory.

Also in the present embodiment, the above-stated plus 3σ value related to toner is approximately 6.9 μm, which is smaller than the depth d (approximately 8 μm) of the depressed sections 515. Therefore, almost all (99% or more) the toner borne in the depressed sections 515 can pass through the (2 μm) gap between the leading edge 560*b* and the opposing area 512*a*, and reach the developing position facing the photoconductor 20. Accordingly, the present embodiment can further inhibit occurrences of development memory.

Also in the developing roller 510 according to the present embodiment the projection sections 512 and the depressed sections 515 are formed so that the depth d of the depressed sections 515 is uniform between all the depressed sections 515 provided in the developing roller 510. Therefore, the toner borne in the depressed sections 515 can pass through the (2 μm) gap between the leading edge 560*b* and the opposing area 512*a*. Accordingly, this embodiment can further inhibit occurrences of development memory.

Also in the present embodiment the projection sections 512 have flat top surfaces, and the projection sections 512 are appropriately prevented from being worn (ground down) due to the load of the regulation blade 560.

The developing roller 510 provided in the developing devices 51, 52, 53, and 54 according to the present embodiment includes the regularly arranged projection sections 512 on the surface thereof. The ten-point average roughness Rz of the projection sections 512 is smaller than the value obtained by subtracting 3 times a standard deviation σ in the particle size distribution of a toner from the volume mean particle size Ave of the toner (namely, minus 3σ value). As a result, occurrences of development memory described above can be inhibited and deterioration in image quality of the finally obtained image is appropriately prevented.

Below, the surface roughness of the developing roller 510 will be described first, and thereafter it will be described why occurrences of development memory can be inhibited and deterioration in image quality can be appropriately prevented by setting the ten-point average roughness Rz of the projection sections 512 on the surface to a value smaller than the minus 3σvalue.

Firstly, the surface roughness of the developing roller 510 will be described. As described above, on the surface of the developing roller 510, two types of spiral groove portions (namely, the first groove portion 516 and the second groove portion 518) having different inclination angles with respect to the circumferential direction are provided, and the two types of spiral groove portions mutually intersect so as to form a grid pattern. On the developing roller 510, the projection sections 512 that have square top surfaces surrounded by the two types of spiral groove portions, and the depressed sections 515 that correspond to the bottom portions of the groove portions are respectively provided in a regular manner.

Figure 15:
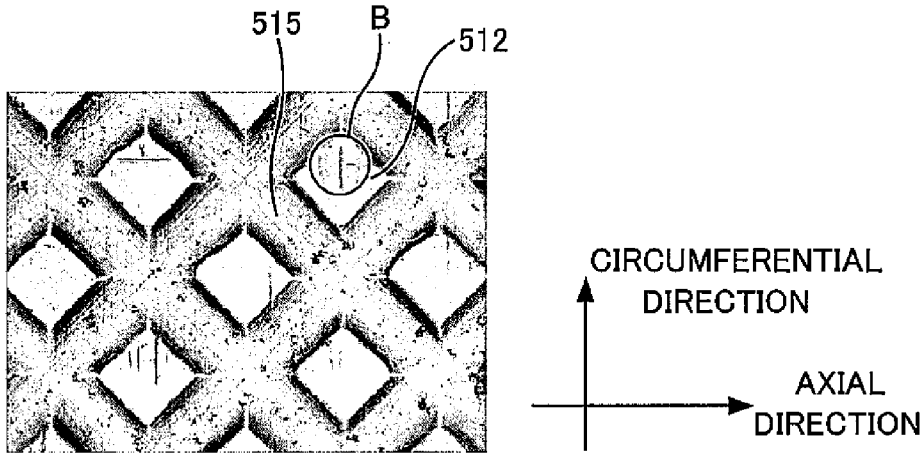
FIG. 15 is a schematic diagram showing the development roller 510 including rough projection sections 512 and depressed sections 515.

Incidentally, the projection sections 512 and the depressed sections 515 are scratched as a result of processing such as cutting or polishing (including the rolling process described below) while manufacturing the developing roller 510, and the projection sections 512 and the depressed sections 515 are roughened as shown in FIG. 15 (for example, small grooves are formed along the circumferential direction as shown in FIG. 15, with the reference symbol "B"). The developing roller 510 according to the present embodiment is maintained during manufacturing so that the surface roughness of the projection sections 512 and the depressed sections 515 (ten-point average roughness Rz) shows a constant value. Specifically, the developing roller 510 is managed during manufacturing so that the ten-point average roughness Rz of the depressed sections 515 is 0.7 μm, and that of the projection sections 512 is 0.3 μm. For this reason, in the manufactured developing roller 510, the ten-point average roughness Rz of the depressed sections 515 is larger than that of the projection sections 512. FIG. 15 is a schematic diagram of the developing roller 510 including rough projection sections 512 and depressed sections 515.

Since the projection sections 512 and the depressed sections 515 are rough, toner having a small particle size fits in and is borne on the rough portions of the projection sections 512 and the depressed sections 515. Specifically, since the ten-point average roughness Rz of the projection sections 512 is 0.3 μm, toner having a particle size of 0.3 μm or less may fit in and be borne on the rough portion (small grooves) in the projection sections 512. Conversely, since the ten-point average roughness Rz of the depressed sections 515 is 0.7 μm, toner having a particle size of 0.7 μm or less may fit in and be borne on the rough portion (small grooves) in the depressed sections 515.

Figure 16:
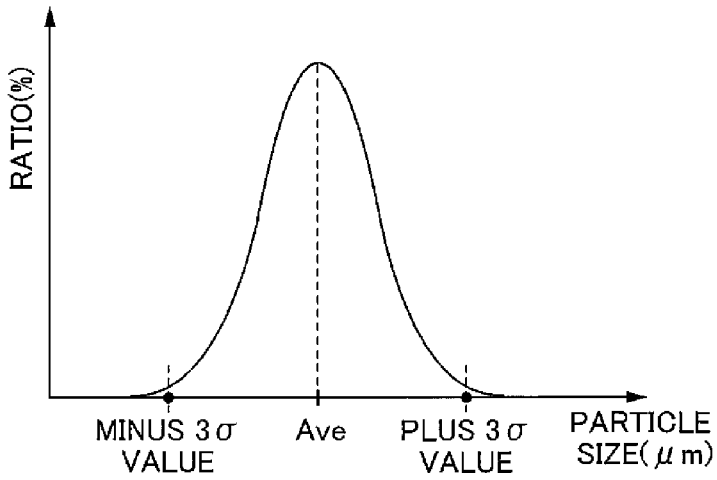
FIG. 16 is a schematic diagram showing the particle size distribution of toner.

As described above, the volume mean particle size Ave of the toner according to the present embodiment is approximately 4.6 μm, the value obtained by subtracting 3 times a standard deviation σ in the toner particle size distribution from the volume mean particle size Ave ("minus 3σ value") is approximately 2.3 μm, and the value obtained by adding 3 times the standard deviation σ in the toner particle size distribution to the volume mean particle size Ave ("plus 3σ value") is approximately 6.9 μm. As shown in FIG. 16, it is generally known that approximately 99% of toner is distributed in a range between the minus 3σ value and the plus 3σ value in the particle size distribution (normal distribution). Therefore, the amount of toner fitting into and borne on the rough portions (small grooves) on the projection sections 512 and the depressed sections 515 is extremely small. FIG. 16 is a schematic diagram showing the particle size distribution of toner.

Next, it will be described why occurrences of development memory can be inhibited and deterioration in image quality in images can be appropriately prevented by setting the ten-point average roughness Rz of the projection sections 512 to a value smaller than the minus 3σ value.

In the first region where toner is not borne, which occurs upon completion of the development processing of the n-th revolution of the developing roller 510, toner contained in the toner container 530 is freshly supplied in the process of charging and supplying toner using the toner supply roller 550 in the (n+1)-th revolution. And description has been given regarding a point above that in the case where the toner freshly supplied to the first region is toner having a property of being a toner whose electrical-charge buildup is slow, the toner will not be borne appropriately on the first region of the developing roller 510 during frictional charging carried out by the toner supply roller 550 and the developing roller 510.

Here, the projection sections 512 and the depressed sections 515 are present within the first region, but the extent of inappropriateness relating to bearing of toner in the first region varies depending on which among the projection sections 512 and the depressed sections 515 of the first region the toner is borne. That is, the non-projection sections 513 including the depressed sections 515 are cupped so as to easily accommodate toner, and therefore toner readily enters the non-projection sections 513. And the toner that has entered the non-projection sections 513 is subjected to packing within the non-projection sections 513, and an agglutinative force produced at this time provides an effect of bearing the toner in the depressed sections 515. Consequently, in the depressed sections 515, even if the toner electrical-charge buildup is slow, the aforementioned inappropriateness relating to bearing of toner in the first region is alleviated. In contrast to this, this effect is not obtained for the projection sections 512, and the extent of inappropriateness is smaller in the depressed sections 515 than the projection sections 512.

For this reason, during the development processing of the (n+1)-th revolution, a difference between the density of the halftone image formed by developing the latent image facing the depressed sections 515 of the first region and the density of the halftone image formed by developing the latent image facing the depressed sections 515 of the second region is smaller than a difference between the density of the halftone image formed by developing the latent image facing the projection sections 512 of the first region and the density of the halftone image formed by developing the latent image facing the projection sections 512 of the second region. In other words, in inhibiting occurrences of development memory, of the projection sections 512 and the depressed sections 515, it is better to as much as possible develop the latent image using toner borne in the depressed sections 515.

Taking such issues into account, in the present embodiment, the ten-point average roughness Rz of the projection sections 512 (approximately 0.3 μm) is smaller than the minus 3σ value (approximately 2.3 μm). Of toners having various particle sizes, toner having a small particle size may fit into and be borne on the rough portion of the projection sections 512, and therefore toner whose particle size is smaller than the ten-point average roughness Rz of the projection sections 512 will be borne on the projection sections 512 (although toner can be borne on the portion of the projection sections 512 that is not rough, the toner rolls during rotation of the developing roller 510 and separates from the portion, so it is hard for the toner to be borne on the projection sections 512). Here, approximately 99% of toner is distributed in a range between the minus 3σ value (approximately 2.3 μm) and the plus 3σ value (approximately 6.9 μm) in the particle size distribution of toner. Therefore, the amount of toner whose particle size is less than the minus 3σ value is extremely small (less than 1%). Accordingly, in the case where the ten-point average roughness Rz of the projection sections 512 is smaller than the minus 3σ value, almost all toner (99%) is not borne on the projection sections 512.

Conversely, the ten-point average roughness Rz of the depressed sections 515 (approximately 0.7 μm) is also smaller than the minus 3σ value and toner whose particle size is smaller than the minus 3σ value can be borne in the depressed sections 515. However, the depressed sections 515 do not bear only toner whose particle size is smaller than the minus 3σ value, and the depressed sections 515 also bear toner having the volume mean particle size (approximately 4.6 μm). This is because the non-projection sections 513 are cupped so as to easily accommodate toner, and the toner having the volume mean particle size is borne in the depressed sections 515 with an aggregation force generated when toner is packed in the non-projection sections 513. The aggregation force acts on the toner borne in the depressed sections 515, and therefore it is difficult for the toner to separate from the depressed sections 515 during rotation of the developing roller 510, and the toner remains to be borne in the depressed sections 515. As a result, a larger amount of toner (mainly the toner having the volume mean particle size) is borne in the depressed sections 515 than on the projection sections 512.

In this manner, in the case where the amount of toner borne in the depressed sections 515 is larger than the amount of toner borne on the projection sections 512, occurrences of development memory is inhibited. That is, the difference between the density of the halftone image formed by developing the latent image facing the first region and the density of the halftone image formed by developing the latent image facing the second region becomes smaller, compared with the case where, for example, the amount of toner borne on the projection sections 512 is equal to the amount of toner borne in the depressed sections 515, and accordingly occurrences of development memory are inhibited. Therefore, deterioration in image quality of the finally obtained image is appropriately prevented.

Also as described above, the regulating state of the regulation blade 560 according to the present embodiment is set so that, as shown in FIG. 9, the distance g (approximately 2 μm) from the leading edge 560*b* to the projection sections 512 in the case where the leading edge 560*b* faces the projection sections 512 of the rotating developing roller 510, is extremely small. Specifically, the distance g is smaller than the minus 3σ value (approximately 2.3 μm), obtained by subtracting 3 times a standard deviation σ in the toner particle size distribution from the volume mean particle size Ave of toner. In this way, as described above, occurrences of the aforementioned development memory can be effectively inhibited.

Specifically, when the toner that has been borne on the projection sections 512 by the toner supply roller 550 has reached the regulation blade 560, the toner that is borne on the projection sections 512 having a particle size greater than 2 μm (almost all toner) is unable to pass through the (2 μm) gap between the leading edge 560*b* and the opposing area 512*a* (it rebounds upon hitting the leading edge 560*b*), and cannot reach the developing position opposing the photoconductor 20. Conversely, when the toner borne in the depressed sections 515 is focused on, the depth d of the depressed sections 515 (approximately 8 μm) is greater than plus 3σ value (approximately 6.9 μm), and therefore the toner that is borne in the depressed sections 515 is able to pass through the (2 μm) gap between the leading edge 560*b* and the opposing area 512*a* and reaches the developing position opposing the photoconductor 20. For this reason, a larger amount of toner (mainly the toner having the volume mean particle size) is borne in the depressed sections 515 than by the projection sections 512. As a result, occurrences of development memory can be effectively inhibited.

Figure 17:
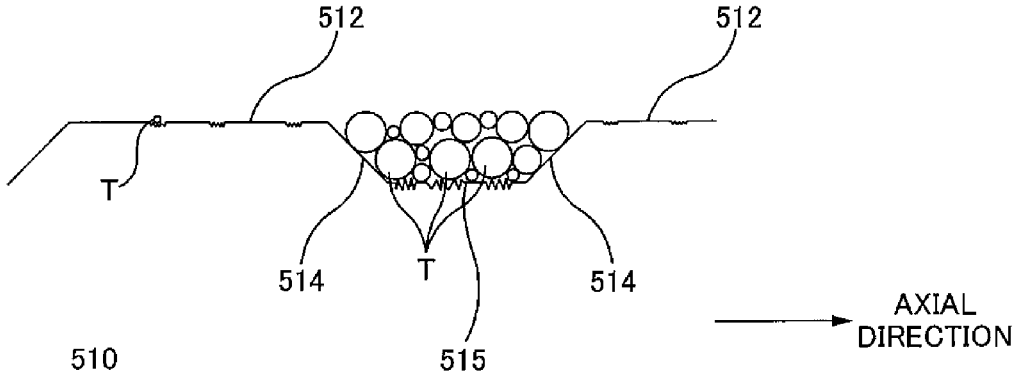
FIG. 17 is a schematic diagram illustrating a state (2) of the toner borne on the projection sections 512 and the non-projection sections 513 at the developing position.

FIG. 17 is a schematic diagram for describing effectiveness of the developing devices 51, 52, 53, and 54 according to the present embodiment. That is, FIG. 17 shows a state of the toner borne on the projection sections 512 and the depressed sections 515 (the non-projection sections 513) at the developing position in the case where the ten-point average roughness Rz of the projection sections 512 is smaller than the minus 3σ value, and also the distance g is smaller than the minus 3σ value. As shown in FIG. 17, in the developing position, almost no toner is borne on the projection sections 512, and toner particles of various sizes are borne on the depressed sections 515. The latent image borne on the photoconductor 20 is mostly developed using the toner borne on the depressed sections 515 (including toner borne on the lateral sections 514), and therefore occurrences of development memory can be more effectively inhibited.

Developing Device Manufacturing Method

Figure 19:
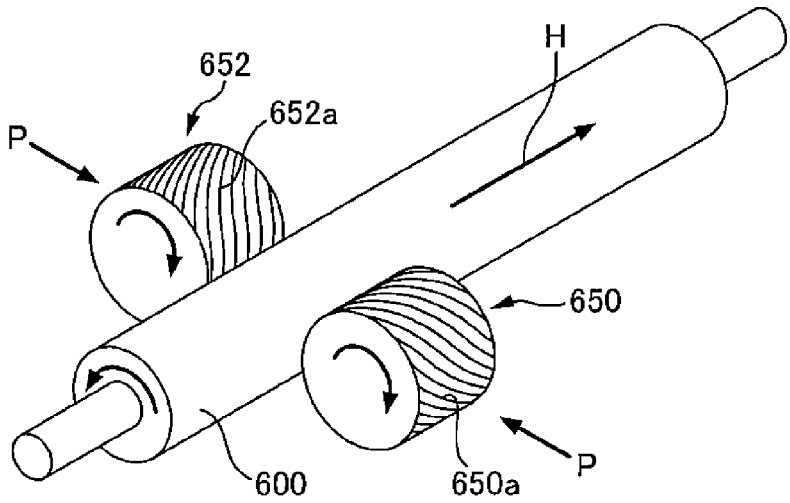
FIG. 19 is an explanatory diagram for describing the rolling process of the developing roller 510.
Figure 20:
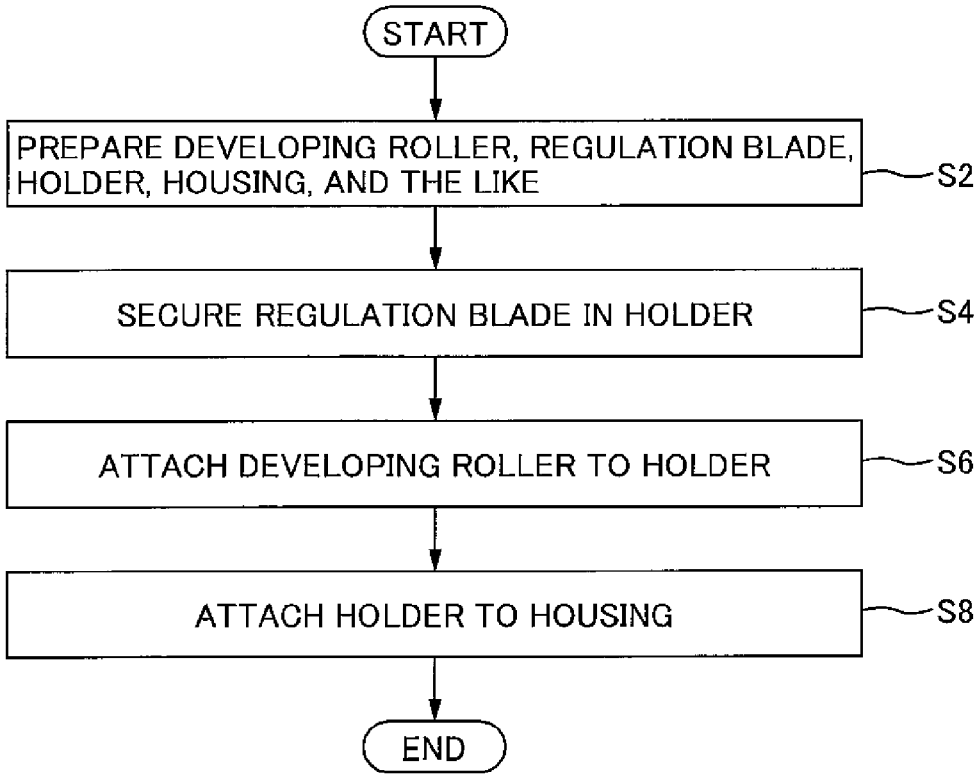
FIG. 20 is a flowchart for describing an assembly method for a yellow developing device 54.

Next, description will be given regarding a method for manufacturing the developing devices with reference to FIGS. 18A to 20. FIGS. 18A to 18E are schematic diagrams showing transitional states of the developing roller 510 during the manufacturing process thereof. FIG. 19 is an explanatory diagram for describing the rolling process of the developing roller 510. FIG. 20 is a flowchart for describing an assembly method for the yellow developing device 54. It should be noted that in manufacturing the developing device, the above-described housing 540, holder 526, developing roller 510, toner supplying roller 550, regulation blade 560 and the like are manufactured first. Then, the developing device is manufactured by assembling these members. Now, among manufacturing methods for these members, the method for manufacturing the developing roller 510 is described first, and thereafter the method for assembling the developing device is described. In the following description, the yellow developing device 54 is taken as an example from among the black developing device 51, the magenta developing device 52, the cyan developing device 53, and the yellow developing device 54.

Method for Manufacturing the Developing Roller 510

The method for manufacturing the developing roller 510 is described with reference to FIG. 18A to FIG. 19.

Figure 18A:
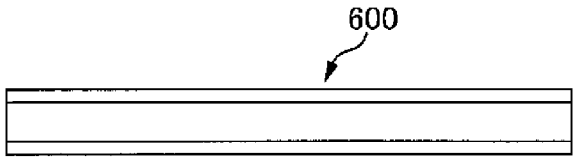
FIG. 18A is a schematic diagram showing a transitional state (1) of the developing roller 510 during the manufacturing process thereof.
Figure 18B:
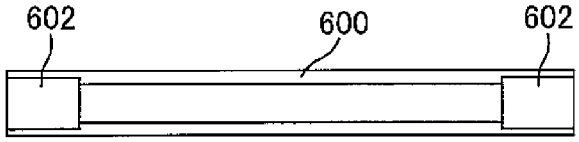
FIG. 18B is a schematic diagram showing a transitional state (2) of the developing roller 510 during the manufacturing process thereof.
Figure 18C:
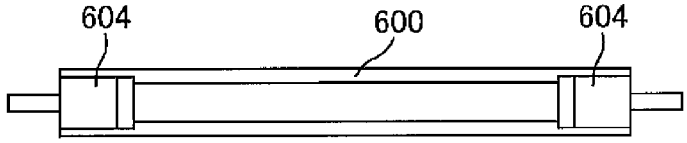
FIG. 18C is a schematic diagram showing a transitional state (3) of the developing roller 510 during the manufacturing process thereof.
Figure 18D:
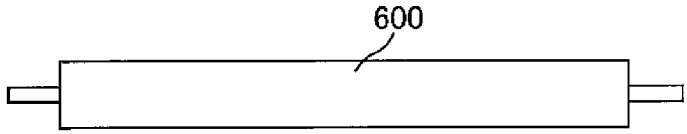
FIG. 18D is a schematic diagram showing a transitional state (4) of the developing roller 510 during the manufacturing process thereof.
Figure 18E:
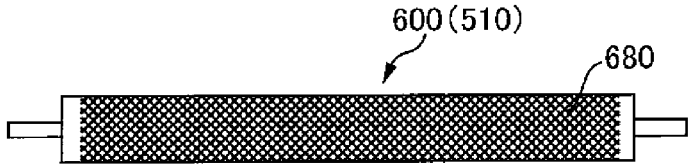
FIG. 18E is a schematic diagram showing a transitional state (5) of the developing roller 510 during the manufacturing process thereof.

First of all, as shown in FIG. 18A, a pipe member 600 is prepared, which is used as the base member of the developing roller 510. The wall thickness of this pipe member 600 is 0.5 to 3 mm. Then, as shown in FIG. 18B, flange press-fitting sections 602 are formed at the both ends in the longitudinal direction of the pipe member 600. The flange press-fitting sections 602 are made by a cutting process. Next, as shown in FIG. 18C, a flange 604 is injected to the flange press-fitting sections 602. In order to reliably fasten the flanges 604 to the pipe member 600, it is also possible to glue or weld the flanges 604 to the pipe member 600 after press-fitting the flanges 604. Next, as shown in FIG. 18D, the surface of the pipe member 600 to which the flanges 604 are injected is subjected to centerless grinding. This centerless grinding is performed on the entire surface, and the ten-point average roughness Rz of the surface after the centerless grinding is equal to or less than 1.0 μm. Next, as shown in FIG. 18E, the pipe member 600 with the flanges 604 injected thereto is subjected to a rolling process. In the present embodiment, a so-called through-feed rolling process (also referred to as "continuous rolling") using two round dies 650, 652 is performed.

That is, as shown in FIG. 19, the two round dies 650, 652 arranged so that they sandwich the pipe member 600 serving as the workpiece are rotated in the same direction (see FIG. 19) while being pressed with a predetermined pressure (the direction of this pressure is marked with the reference symbol P in FIG. 19) against the pipe member 600. In the through feed rolling, due to rotation of the round dies 650 and 652, the pipe member 600 moves in the direction indicated by the reference symbol H in FIG. 19 while rotating in the direction opposite to the rotating direction of the round dies 650 and 652 (see FIG. 19). Convex sections 650*a* and 652*a* for forming a groove 680 are provided respectively on the surface of the round dies 650 and 652. The convex sections 650*a* and 652*a* deform the pipe member 600 to form the groove 680 on the pipe member 600 (here the groove 680 corresponds to the first groove portion 516 and the second groove portion 518).

After the completion of the rolling process, plating is performed on the surface of the central area 510*a*. In this embodiment, electroless Ni—P plating is employed. However, there is no limitation to this, and hard chrome plating or electroplating may be employed for example.

The projection sections 512 and the depressed sections 515 of the developing roller 510 manufactured in this manner are rough, and the ten-point average roughness Rz of the projection sections 512 and the ten-point average roughness Rz of the depressed sections 515 are approximately 0.3 μm and approximately 0.7 μm, respectively. Note that the projection sections 512 and the depressed sections 515 are rough because the projection sections 512 and the depressed sections 515 are scratched (small grooves are formed) during centerless grinding or the rolling process. In the rolling process, because the convex sections 650*a* and 652*a* of the dies 650 and 652 are rough, the projection sections 512 and the depressed sections 515 formed by the convex sections 650*a* and 652*a* are also rough.

Method for Assembling the Yellow Developing Device 54

A method for assembling the yellow developing device 54 is described with reference to FIG. 20.

First, the above-described housing 540, holder 526, developing roller 510, regulation blade 560, blade support member 564, and the like are prepared (step S2).

Next, the regulation blade 560 and the blade support member 564 are secured to the holder 526 as a result of the regulation blade 560 and the blade support member 564 being fixed to the regulation blade support sections 526*c* of the holder 526 with screws (step S4). It should be noted that the aforementioned end portion seal 574 is attached to the regulation blade 560 ahead of this step S4.

Next, the developing roller 510 is attached to the holder 526 to which the regulation blade 560 and the blade support member 564 have been secured (step S6). At this time, the developing roller 510 is attached to the holder 526 so that the regulation blade 560 contacts the developing roller 510 through one end to the other end in the rotation-axis direction of the developing roller 510. The aforementioned upper seal 520 is attached to the holder 526 ahead of this step S6.

Then, the holder 526 to which the developing roller 510, regulation blade 560 and the like have been attached, is attached to the housing 540 via the housing seal 546 (step S8), thereby completing assembly of the yellow developing device 54. It should be noted that the aforementioned toner supply roller 550 is attached to the housing 540 ahead of this step S8.

Other Embodiments

A developing device or the like according to the invention was described by way of the foregoing embodiment, but the foregoing embodiment of the invention is merely for the purpose of elucidating the invention and is not to be interpreted as limiting the invention. The invention can of course be altered and improved without departing from the gist thereof and equivalents are intended to be embraced therein.

In the foregoing embodiment, an intermediate transfer type full-color laser beam printer was described as an example of the image forming apparatus, but the invention can also be applied to various other types of image forming apparatuses, such as full-color laser beam printers that are not of the intermediate transfer type, monochrome laser beam printers, copying machines, and facsimile machines.

Moreover, the photoconductor is not limited to a so-called photosensitive roller, which is configured by providing a photoconductive layer on the outer circumferential surface of a hollow cylindrical conductive base, and can also be a so-called photosensitive belt, which is configured by providing a photoconductive layer on the surface of a belt-shaped conductive base.

Also, the shape of the projection sections 512 and the non-projection sections 513 of the developing roller 510 (including the lateral sections 514 and depressed sections 515) is not limited to the shape described above.

Also in the above embodiment, as a method for enabling development of latent images by the developing roller 510 in a state in which the projection section covering ratio is smaller than the depressed section covering ratio, a method (an example) was described for regulating the amount of toner by the regulation blade 560 so that the projection section covering ratio is smaller than the depressed section covering ratio. As an example of such methods, a method was described in which the regulation blade 560 is disposed so that its leading edge 560*b* of the regulation blade 560 faces the upstream side of the developing roller 510 in the rotating direction, and also a part of the toner borne on the projection sections 512 is hit and rebounded by the regulation blade 560 by setting the distance g from the leading edge 560*b* to the projection sections 512 in the case where the leading edge 560*b* faces the projection sections 512 of the rotating developing roller 510 to a value smaller than the volume mean particle size of toner. However, there is no limitation to this method.

For example, the amount of toner borne on the developing roller 510 may be regulated by the regulation blade 560 whose contact section 560*a* is roughened (during processing). In this manner, the protruded portions in the roughened contact section 560*a* flick away a part of toner borne on the projection sections 512, so the projection section covering ratio can be made smaller than the depressed section covering ratio.

Also, on the regulation blade 560 according to the above embodiment, the contact section 560*a* is positioned at a position separated from the leading edge 560*b*. That is, a configuration was adopted in which the leading edge 560*b* does not contact the developing roller 510. However, there is no limitation to this and the leading edge 560*b* may contact the developing roller 510 (in such a case, the manner of regulation by the regulation blade 560 will be regulation by the leading edge of the blade, and the distance g from the leading edge 560*b* to the projection sections 512 in the case where the leading edge 560*b* faces the projection sections 512 of the rotating developing roller 510 will be 0).

In the case where the manner of regulation by the regulation blade 560 is regulation by its leading edge, there is a risk that while the regulation blade 560 is regulating the amount of toner borne on the developing roller 510, the leading edge 560*b* will go into the non-projection sections S13 (groove portions) and collide with the lateral sections 514 of the non-projection sections 513, and be chipped. Conversely, in the case where the contact section 560*a* is positioned at a position separated from the leading edge 560*b*, such a problem will not occur. As a result, in regard to this point, the above-described embodiment is preferable.

Also, the toner used in the printer 10 according to the above embodiment has properties described in the paragraphs 1) to 4). However, there is no limitation to this. It is not required to have these properties.

In the case where the toner has these properties, as described above, development memory tends to occur easily in the printer 10, in which such a toner is used. Accordingly, in such a case, the effect of the invention, that is, inhibition of occurrences of development memory and appropriate prevention of the deterioration in image quality of the finally obtained images are exhibited more effectively. In regard to this point the above-described embodiment is more preferable.

Also in the above embodiment, a configuration was adopted in which the plus 3σ value is smaller than the depth d of the depressed sections 515. However, there is no limitation to this. For example, the plus 3σ value may be larger than the depth d of the depressed sections 515.

In the above embodiment, the developing roller 510 can rotate. The printer 10 is provided with the regulation blade 560 for regulating the amount of toner borne on the surface of the developing roller 510 by coming into contact with the surface, the regulation blade 560 being disposed so that the longitudinal direction thereof runs along the rotation-axis direction of the developing roller 510, and the leading edge 560*b* thereof in the lateral direction and the thickness direction faces the upstream side of the developing roller 510 in the rotating direction. Furthermore, the distance g (FIG. 9) from the leading edge 560*b* to the projection sections 512 in the case where the leading edge 560*b* faces the projection sections 512 is smaller than a value (minus 3σ value) obtained by subtracting 3 times a standard deviation σ in the particle size distribution of a toner from the volume mean particle size Ave of the toner. However, there is no limitation to this. For example, the distance g may be greater than the minus 3σ value.

It should be noted that almost all toner (99% of toner) has a particle size larger than the minus 3σ value (approximately 2.3 μm), and in the case where the distance g is smaller than the minus 3σ value, almost no toner will be borne on the projection sections 512 after regulation by the regulation blade 560. Therefore, development with the toner borne on the depressed sections 515 is facilitated and occurrences of development memory can be inhibited more effectively. In regard to this point the above-described embodiment is more preferable.

Also, in the above embodiment, a configuration was adopted in which the projection sections 512 and the depressed sections 515 that bear toner are disposed in a regular manner on the surface of the developing roller 510, and the ten-point average roughness Rz of the depressed sections 515 (approximately 0.7 μm) is larger than the ten-point average roughness Rz of the projection sections 512 (approximately 0.3 μm). However, there is no limitation to this. For example, the ten-point average roughness Rz of the depressed sections 515 may be smaller than the ten-point average roughness Rz of the projection sections 512.

In the case where the ten-point average roughness Rz of the depressed sections 515 is larger than the ten-point average roughness Rz of the projection sections 512, the charging amount of the toner increases as a result of the toner contacting the depressed sections 515 rolling, which makes it easier for the toner to remain in the depressed sections 515. As a result, discharge between the depressed sections 515 and the photoconductor 20 that have just passed the developing position can be suppressed. In regard to this point the above-described embodiment is more preferable.

Furthermore, the depressed sections 515 were bottom portions of two types of spiral groove portions (that is, the first groove portion 516 and the second groove portion 518) having different inclination angles with respect to the circumferential direction of the developing roller 510, and the two types of spiral groove portions mutually intersected so as to form a grid pattern. The projection sections 512 were square top surfaces surrounded by the two types of spiral groove portions, and one of two diagonal lines of the square top surface ran along the circumferential direction of the developing roller 510. However, there is no limitation to this. For example, the projection sections 512 may be rhomboid top surfaces or circular top surfaces or the like.

Configuration of the Image Forming System, etc.

Next, an embodiment of an image forming system serving as an example of an embodiment of the present invention is described with reference to the drawings.

Figure 21:
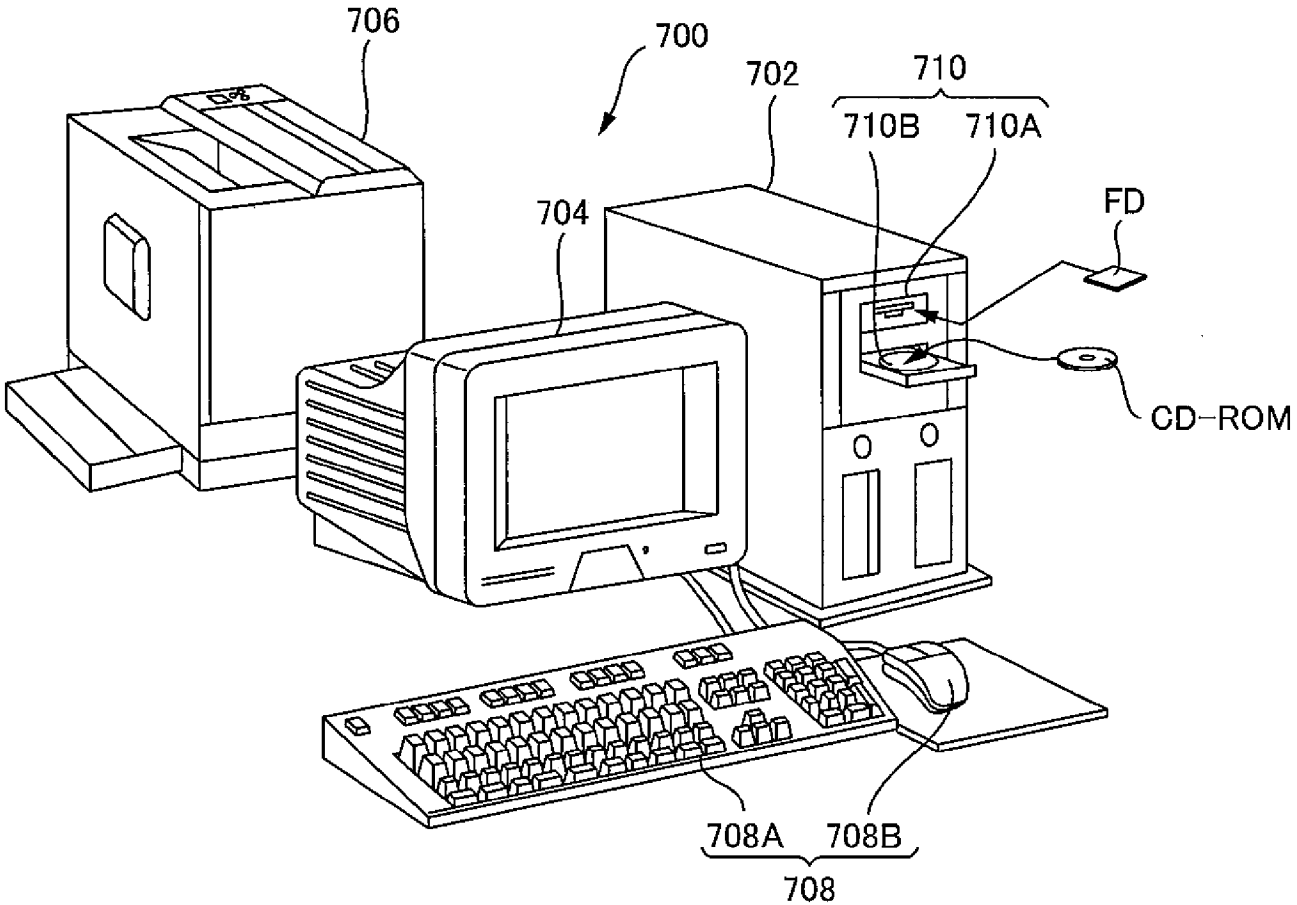
FIG. 21 is an explanatory diagram showing an external configuration of an image forming system.

FIG. 21 is an explanatory diagram showing an external configuration of an image forming system. An image forming system 700 is provided with a computer 702, a display device 704, a printer 706, input devices 708, and reading devices 710. In this embodiment, the computer 702 is contained within a mini-tower type housing, but there is no limitation to these. A CRT (cathode ray tube), plasma display, or liquid crystal display device, for example, is generally used as the display device 704, but there is no limitation to this. The printer described above is used as the printer 706. In this embodiment, the input devices 708 are a keyboard 708A and a mouse 708B, but there is no limitation to these. In this embodiment, a flexible disk drive device 710A and a CD-ROM drive device 710B are used as the reading device 710, but the reading device 710 is not limited to these, and it may also be an MO (magnet optical) disk drive device or a DVD (digital versatile disk), for example.

Figure 22:
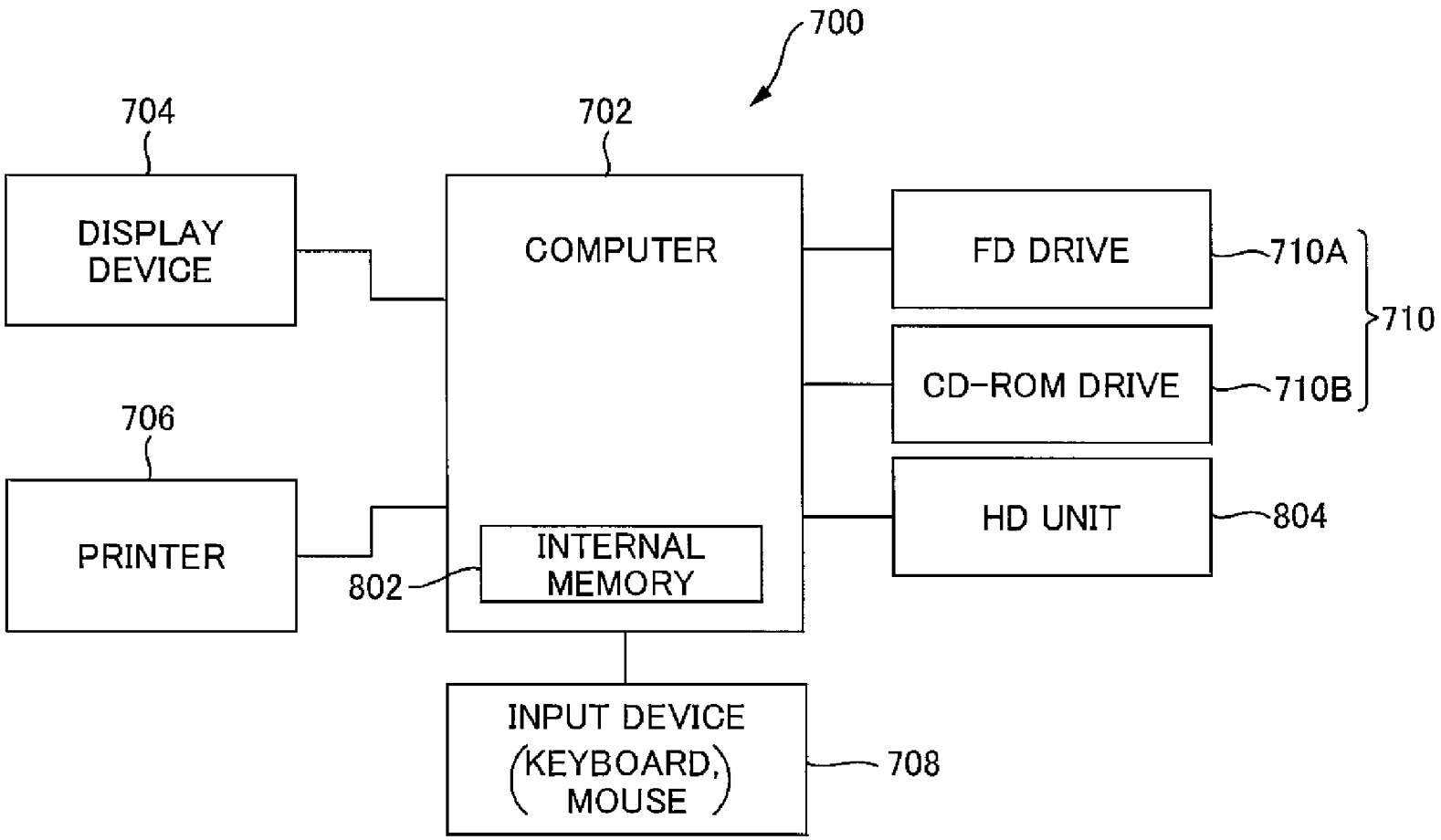
FIG. 22 is a block diagram showing the configuration of the image forming system shown in FIG. 21.

FIG. 22 is a block diagram showing the configuration of the image forming system shown in FIG. 21. An internal memory 802 such as a RAM is provided within the casing containing the computer 702, and furthermore an external memory such as a hard disk drive unit 804 is provided.

In the above explanations, an example was given in which the image forming system is constituted by connecting the printer 706 to the computer 702, the display device 704, the input devices 708, and the reading devices 710, but there is no limitation to this. For example, the image forming system may also be made of the computer 702 and the printer 706, and the image forming system does not have to be provided with any one of the display device 704, the input devices 708, and the reading devices 710.

It is also possible that the printer 706 for example has some of the functions or mechanisms of the computer 702, the display device 704, the input devices 708, and the reading devices 710. For example, the printer 706 may be configured so as to have an image processing section for carrying out image processing, a display section for carrying out various types of displays, and a recording media mount/dismount section into and from which recording media storing image data captured by a digital camera or the like are inserted and taken out.

As an overall system, the image forming system that is thus achieved is superior to conventional systems.

Although the preferred embodiment of the invention has been described in detail, it should be understood that various changes, substitutions and alterations can be made therein without departing from spirit and scope of the inventions as defined by the appended claims.

What is claimed is:

1. A developing device comprising:

a toner bearing member that includes regularly arranged projection sections and depressed sections for bearing toner, and that develops a latent image borne on an image bearing member with the toner borne on the projection sections and the depressed sections, wherein the latent image is developed in a state in which a projection section covering ratio at which toner contacting the projection sections covers the projection sections is smaller than a depressed section covering ratio at which toner contacting the depressed sections covers the depressed sections; and a regulation member for regulating an amount of toner borne on the projection sections and the depressed sections, wherein after the regulation member has regulated the amount of toner so that the projection section covering ratio is smaller than the depressed section covering ratio, the toner bearing member develops the latent image in a state in which the projection section covering ratio is smaller than the depressed section covering ratio, the toner bearing member is a rotatable toner bearing roller that includes the projection sections and the depressed sections for bearing toner whose volume mean particle size is smaller than a depth of the depressed sections in reference to the projection sections, the regulation member is a regulation blade for regulating the amount of toner borne on the projection sections and the depressed sections by coming into contact with the toner bearing roller at a contact section so that a longitudinal direction of the regulation member runs along a rotation-axis direction of the toner bearing roller, and is disposed so that a leading edge of the regulation blade in a lateral direction and a thickness direction faces an upstream side of the toner bearing member in a rotating direction, and a distance from the leading edge to the projection sections in the case where the leading edge faces the projection sections among the projection sections and the depressed sections is smaller than the volume mean particle size.

2. An image forming apparatus, comprising:

an image bearing member for bearing a latent image; and a developing device provided with a toner bearing member including regularly arranged projection sections and depressed sections for bearing toner, the toner bearing member developing a latent image borne on the image bearing member with the toner borne on the projection sections and the depressed sections, the toner bearing member developing the latent image in a state in which a projection section covering ratio at which toner contacting the projection sections covers the projection sections is smaller than a depressed section covering ratio at which toner contacting the depressed sections covers the depressed sections; and a regulation member for regulating an amount of toner borne on the projection sections and the depressed sections, wherein after the regulation member has regulated the amount of toner so that the projection section covering ratio is smaller than the depressed section covering ratio, the toner bearing member develops the latent image in a state in which the projection section covering ratio is smaller than the depressed section covering ratio, the toner bearing member is a rotatable toner bearing roller that includes the projection sections and the depressed sections for bearing toner whose volume mean particle size is smaller than a depth of the depressed sections in reference to the projection sections, the regulation member is a regulation blade for regulating the amount of toner borne on the projection sections and the depressed sections by coming into contact with the toner bearing roller at a contact section so that a longitudinal direction of the regulation member runs along a rotation-axis direction of the toner bearing roller, and is disposed so that a leading edge of the regulation blade in a lateral direction and a thickness direction faces an upstream side of the toner bearing member in a rotating direction, and a distance from the leading edge to the projection sections in the case where the leading edge faces the projection sections among the projection sections and the depressed sections is smaller than the volume mean particle size.

3. An image forming system, comprising:

a computer; and an image forming apparatus that can be connected to the computer, the image forming apparatus including an image bearing member for bearing a latent image, and a developing device provided with a toner bearing member including regularly arranged projection sections and depressed sections for bearing toner, and that develops a latent image borne on the image bearing member with the toner borne on the projection sections and the depressed sections, the toner bearing member developing the latent image in a state in which a projection section covering ratio at which toner contacting the projection sections covers the projection sections is smaller than a depressed section covering ratio at which toner contacting the depressed sections covers the depressed sections; and a regulation member for regulating an amount of toner borne on the projection sections and the depressed sections, wherein after the regulation member has regulated the amount of toner so that the projection section covering ratio is smaller than the depressed section covering ratio, the toner bearing member develops the latent image in a state in which the projection section covering ratio is smaller than the depressed section covering ratio, the toner bearing member is a rotatable toner bearing roller that includes the projection sections and the depressed sections for bearing toner whose volume mean particle size is smaller than a depth of the depressed sections in reference to the projection sections, the regulation member is a regulation blade for regulating the amount of toner borne on the projection sections and the depressed sections by coming into contact with the toner bearing roller at a contact section so that a longitudinal direction of the regulation member runs along a rotation-axis direction of the toner bearing roller, and is disposed so that a leading edge of the regulation blade in a lateral direction and a thickness direction faces an upstream side of the toner bearing member in a rotating direction, and a distance from the leading edge to the projection sections in the case where the leading edge faces the projection sections among the projection sections and the depressed sections is smaller than the volume mean particle size.

4. A developing device, comprising:

a rotatable toner bearing roller that includes regularly arranged projection sections and depressed sections and that bears toner whose volume mean particle size is smaller than a depth of the depressed sections in reference to the projection sections, the toner bearing roller developing a latent image borne on an image bearing member with the toner borne on the toner bearing roller; and a regulation blade for regulating an amount of toner borne on the toner bearing roller by contacting the toner bearing roller at a contact section so that a longitudinal direction of the regulation blade runs along a rotation-axis direction of the toner bearing roller, the regulation blade being disposed so that a leading edge of the regulation blade in a lateral direction and a thickness direction faces an upstream side of the toner bearing roller in a rotating direction, wherein a distance from the leading edge to the projection sections in the case where the leading edge faces the projection sections among the projection sections and the depressed sections is smaller than the volume mean particle size.

5. A developing device according to claim 4, wherein the contact section is positioned at a position separated from the leading edge.

6. A developing device according to claim 4, wherein the distance is smaller than a value obtained by subtracting 3 times a standard deviation in a toner particle size distribution from the volume mean particle size.

7. A developing device according to claim 4, wherein a value obtained by adding 3 times a standard deviation in a toner particle size distribution to the volume mean particle size is smaller than the depth of the depressed sections.

8. A developing device according to claim 4, wherein the projection sections and the depressed sections are formed in the toner bearing roller so that the depth of the depressed sections is uniform between all the depressed sections provided in the toner bearing roller.

9. A developing device according to claim 4, wherein the projection sections have flat top surfaces.

10. An image forming apparatus, comprising:

an image bearing member for bearing a latent image;

a developing device provided with a rotatable toner bearing roller that includes regularly arranged projection sections and depressed sections, and that bears toner whose volume mean particle size is smaller than a depth of the depressed sections in reference to the projection sections, the toner bearing roller developing a latent image borne on the image bearing member with the toner borne on the toner bearing roller, and a regulation blade for regulating an amount of toner borne on the toner bearing roller by contacting the toner bearing roller at a contact section so that a longitudinal direction of the regulation blade runs along a rotation-axis direction of the toner bearing roller, the regulation blade being disposed so that a leading edge of the regulation blade in a lateral direction, of a contact face including the contact section, faces an upstream side of the toner bearing roller in a rotating direction, wherein a distance from the leading edge to the projection sections in the case where the leading edge faces the projection sections among the projection sections and the depressed sections is smaller than the volume mean particle size.

11. An image forming system, comprising:

a computer; and an image forming apparatus that can be connected to the computer, the image forming apparatus including an image bearing member for bearing a latent image, and a developing device provided with a rotatable toner bearing roller that includes regularly arranged projection sections and depressed sections, and that bears toner whose volume mean particle size is smaller than a depth of the depressed sections in reference to the projection sections, the toner bearing roller developing a latent image borne on the image bearing member with the toner borne on the toner bearing roller, and a regulation blade for regulating an amount of toner borne on the toner bearing roller by contacting the toner bearing roller at a contact section so that a longitudinal direction of the regulation blade runs along a rotation-axis direction of the toner bearing roller, the regulation blade being disposed so that a leading edge in a lateral direction of the regulation blade, of a contact face including the contact section, faces an upstream side of the toner bearing roller in a rotating direction, wherein a distance from the leading edge to the projection sections in the case where the leading edge faces the projection sections among the projection sections and the depressed sections is smaller than the volume mean particle size.

12. A developing device, comprising:

a toner bearing member that bears toner on a surface thereof and that develops a latent image borne on an image bearing member with the toner, wherein the toner bearing member includes projection sections that are regularly arranged on the surface, a ten-point average roughness of the projection sections being smaller than a value obtained by subtracting 3 times a standard deviation in a particle size distribution of the toner from a volume mean particle size of the toner.

13. A developing device, according to claim 12, wherein the toner bearing member is rotatable, and a regulation member is provided that regulates an amount of toner borne on the surface of the toner bearing member by contacting the surface, the regulation member being disposed so that a longitudinal direction of the regulation member runs along a rotation-axis direction of the toner bearing member, and the leading edge in a lateral direction and a thickness direction of the regulation member faces an upstream side of the toner bearing member in a rotating direction, and a distance between the leading edge and the projection sections in the case where the leading edge faces the projection sections is smaller than a value obtained by subtracting 3times a standard deviation in a particle size distribution of the toner from a volume mean particle size of the toner.

14. A developing device, according to claim 12, wherein the projection sections and depressed sections that bear the toner are regularly arranged on the surface of the toner bearing member, and a ten-point average roughness of the depressed sections is larger than the ten-point average roughness of the projection sections.

15. A developing device, according to claim 14, wherein the depressed sections are bottom portions of two types of spiral groove portions having different inclination angles with respect to a circumferential direction of the toner bearing member, the two types of spiral groove portions mutually intersect so as to form a grid pattern, the projection sections are a square top surface surrounded by the two types of spiral groove portions, and one of two diagonal lines of the square top surface runs along the circumferential direction.

16. A toner bearing member, comprising:

a surface that bears toner for developing a latent image borne on an image bearing member; and projection sections regularly arranged on the surface, a ten-point average roughness of the projection sections being smaller than a value obtained by subtracting 3 times a standard deviation in a particle size distribution of the toner from a volume mean particle size of the toner.

17. An image forming apparatus comprising:

an image bearing member for bearing a latent image; and a developing device provided with a toner bearing member that bears toner on a surface thereof and that develops a latent image borne on the image bearing member with the toner, the toner bearing member including projection sections regularly arranged on the surface, and a ten-point average roughness of the projection sections being smaller than a value obtained by subtracting 3 times a standard deviation in a particle size distribution of the toner from a volume mean particle size of the toner.

18. An image forming system comprising:

a computer; and an image forming apparatus that can be connected to the computer, the image forming apparatus including an image bearing member that bears a latent image, and a developing device provided with a toner bearing member that bears toner on a surface thereof and that develops a latent image borne on the image bearing member with the toner, the toner bearing member including projection sections regularly arranged on the surface thereof, and a ten-point average roughness of the projection sections being smaller than a value obtained by subtracting 3 times a standard deviation in a particle size distribution of the toner from a volume mean particle size of the toner.

* * * * *